US009517376B2

(12) United States Patent
Hamilton

(10) Patent No.: US 9,517,376 B2
(45) Date of Patent: Dec. 13, 2016

(54) PORTABLE AND ATTACHABLE BICYCLE TRAINER

(71) Applicant: Brian H. Hamilton, Charlotte, NC (US)

(72) Inventor: Brian H. Hamilton, Charlotte, NC (US)

( * ) Notice: Subject to any disclaimer, the term of this patent is extended or adjusted under 35 U.S.C. 154(b) by 0 days.

(21) Appl. No.: 14/658,846

(22) Filed: Mar. 16, 2015

(65) Prior Publication Data

US 2015/0182774 A1 Jul. 2, 2015

Related U.S. Application Data

(63) Continuation of application No. 13/159,816, filed on Jun. 14, 2011, now Pat. No. 8,979,715, which is a continuation-in-part of application No. 12/725,654, filed on Mar. 17, 2010, now abandoned, which is a continuation-in-part of application No. 12/270,223, filed on Nov. 13, 2008, now Pat. No. 7,955,228, which is a continuation-in-part of application No. 12/206,696, filed on Sep. 8, 2008, now Pat. No. 7,766,798.

(Continued)

(51) Int. Cl.

| | |
|---|---|
| ***A63B 69/16*** | (2006.01) |
| ***A63B 21/012*** | (2006.01) |
| ***A63B 24/00*** | (2006.01) |
| *A63B 21/00* | (2006.01) |
| *A63B 21/015* | (2006.01) |
| *A63B 21/008* | (2006.01) |

(52) U.S. Cl.

CPC ..... *A63B 21/0125* (2013.01); *A63B 24/0087* (2013.01); *A63B 69/16* (2013.01); *A63B 21/008* (2013.01); *A63B 21/00069* (2013.01); *A63B 21/015* (2013.01); *A63B 2024/009* (2013.01); *A63B 2069/163* (2013.01); *A63B 2069/165* (2013.01); *A63B 2069/166* (2013.01); *A63B 2220/78* (2013.01)

(58) Field of Classification Search

USPC ..... 482/57–65

See application file for complete search history.

(56) References Cited

U.S. PATENT DOCUMENTS

| | | | |
|---|---|---|---|
| 627,483 | A | 6/1899 | Comly |
| 1,661,679 | A | 3/1928 | Privett |

(Continued)

*Primary Examiner* — Stephen Crow

(74) *Attorney, Agent, or Firm* — Additon, Higgins & Pendleton, P.A.

(57) ABSTRACT

The invention encompasses a removable attachment for installing on a bicycle with the goal of altering the resistance to either front tire or back tire revolution. In this way, the bicycle includes enhanced physical training capabilities allowing the rider to use a bicycle on a standard trainer frame or as a regular bicycle for riding in the usual manner. In one embodiment, the attachment includes a resistance support connected to a bicycle and supporting a resistance device that engages a bicycle wheel or bicycle tire for altering the resistance to tire revolution. In this exemplary embodiment, the apparatus includes a resistance support attached to the bicycle proximate a bicycle tire along with a resistance device removably attached to the resistance support. In one embodiment, the resistance device defines a slot, and the resistance support projects through the slot to position the resistance device against the bicycle wheel or the bicycle tire.

20 Claims, 51 Drawing Sheets

Related U.S. Application Data

(60) Provisional application No. 61/354,676, filed on Jun. 14, 2010.

(56) References Cited

U.S. PATENT DOCUMENTS

| | | | | |
|---|---|---|---|---|
| 2,462,018 | A | 2/1949 | Wood | |
| 2,972,478 | A * | 2/1961 | Raines | A63B 69/16 211/22 |
| 4,423,863 | A | 1/1984 | Figueroa | |
| 4,506,676 | A | 3/1985 | Duska | |
| 4,645,199 | A | 2/1987 | Bloemendaal | |
| 4,752,066 | A | 6/1988 | Housayama | |
| 4,813,062 | A | 3/1989 | Gilpatrick | |
| 4,955,600 | A | 9/1990 | Hoffenberg et al. | |
| 4,958,832 | A | 9/1990 | Kim | |
| 5,031,901 | A * | 7/1991 | Saarinen | A63B 21/0051 310/191 |
| 5,052,705 | A * | 10/1991 | Ringle | B62M 13/04 280/212 |
| 5,110,118 | A | 5/1992 | Winey | |
| 5,193,106 | A | 3/1993 | DeSena | |
| 5,236,069 | A | 8/1993 | Peng | |
| RE34,479 | E | 12/1993 | Minoura | |
| 5,382,208 | A * | 1/1995 | Hu | A63B 21/0051 482/61 |
| 5,433,681 | A * | 7/1995 | Minoura | A63B 21/0051 482/61 |
| 5,522,781 | A * | 6/1996 | Minoura | A63B 21/0051 482/61 |
| 5,545,982 | A * | 8/1996 | Vlakancic | B62L 1/12 188/24.22 |
| 5,656,001 | A | 8/1997 | Baatz | |
| 5,916,067 | A * | 6/1999 | Morasse | A63B 69/16 482/61 |
| 5,944,637 | A | 8/1999 | Stickler et al. | |
| 6,042,517 | A | 3/2000 | Gunther et al. | |
| 6,116,415 | A | 9/2000 | Rastelli | |
| 6,450,922 | B1 | 9/2002 | Henderson et al. | |
| 6,508,745 | B1 | 1/2003 | Schenk et al. | |
| 6,568,446 | B1 | 5/2003 | Schulte | |
| 6,712,737 | B1 | 3/2004 | Nusbaum | |
| 6,749,543 | B2 | 6/2004 | McLaughlin | |
| 6,857,992 | B1 | 2/2005 | Kolda et al. | |
| 6,910,992 | B2 | 6/2005 | Arguilez | |
| 6,945,916 | B2 * | 9/2005 | Schroeder | A63B 21/15 482/57 |
| 6,945,917 | B1 | 9/2005 | Baatz | |
| 6,964,633 | B2 | 11/2005 | Kolda et al. | |
| 7,011,607 | B2 * | 3/2006 | Kolda | A63B 21/0051 482/57 |
| 7,083,551 | B1 | 8/2006 | Lassanske et al. | |
| 7,226,395 | B2 | 6/2007 | Wu et al. | |
| 7,303,510 | B2 | 12/2007 | Gebhardt | |
| 7,311,640 | B2 | 12/2007 | Baatz | |
| 7,314,434 | B2 * | 1/2008 | Chen | A63B 21/0051 188/164 |
| 7,413,531 | B2 | 8/2008 | McLaughlin | |
| 7,470,220 | B2 * | 12/2008 | Hernandez | A63B 21/012 188/25 |
| D593,625 | S | 6/2009 | Pedrini | |
| 7,628,739 | B2 | 12/2009 | Gearon | |
| 7,766,798 | B2 * | 8/2010 | Hamilton | A63B 24/0087 434/61 |
| 7,955,228 | B2 * | 6/2011 | Hamilton | A63B 24/0087 482/61 |
| 8,162,806 | B2 * | 4/2012 | Hamilton | A63B 24/0087 482/58 |
| 8,313,419 | B2 | 11/2012 | Hamilton | |
| 8,439,808 | B2 | 5/2013 | Hamilton | |
| 8,979,715 | B2 * | 3/2015 | Hamilton | A63B 24/0087 482/61 |
| 2002/0055422 | A1 | 5/2002 | Airmet et al. | |
| 2002/0193207 | A1 | 12/2002 | Wang | |
| 2003/0073546 | A1 | 4/2003 | Lassanske et al. | |
| 2004/0053751 | A1 | 3/2004 | Pizolato | |
| 2005/0008992 | A1 | 1/2005 | Westergaard et al. | |
| 2005/0209064 | A1 * | 9/2005 | Peterson | A63B 22/16 482/61 |
| 2006/0229163 | A1 * | 10/2006 | Waters | A63B 24/0006 482/8 |
| 2007/0004565 | A1 | 1/2007 | Gebhardt | |
| 2010/0200136 | A1 | 8/2010 | Hamilton | |
| 2013/0079199 | A1 | 3/2013 | Hamilton | |
| 2014/0150939 | A1 | 6/2014 | Hamilton | |

* cited by examiner

PORTABLE AND ATTACHABLE BICYCLE TRAINER

CROSS REFERENCE TO RELATED APPLICATIONS

This application is a continuation of U.S. patent application Ser. No. 13/159,816, filed Jun. 14, 2011, which itself claims priority to U.S. Provisional Patent Application No. 61/354,676, filed on Jun. 14, 2010, U.S. Pat. No. 7,766,798, filed on Sep. 8, 2008, U.S. Pat. No. 7,955,228, filed on Nov. 13, 2008, and U.S. patent application Ser. No. 12/725,654, filed on Mar. 17, 2010. Each of these applications is incorporated by reference as if set forth fully herein.

FIELD OF INVENTION

The invention relates to the field of bicycles and devices that attach to bicycles to adjust the resistance to pedaling and to provide a mechanism to enhance physical fitness training capabilities of the bicycle.

BACKGROUND

The invention is an improvement to bicycle trainers. In the prior art, individuals desiring to exercise with a bicycle have two options: (i) a stationary bicycle installed in a gym or a home or (ii) a portable trainer to which the individual attaches a standard bicycle. Both of these options require the user to exercise in one location, usually inside. A need exists in the area of bicycle training for equipment that allows an individual to use a specialized training regimen while riding a bicycle outside along a standard travel surface (i.e., a road, a track, a trail, and the like). Currently, an individual using a standard bicycle for exercise can adjust the intensity of the workout by riding the bicycle along planned routes of varying elevations, changing gears on the bicycle to require more intense pedaling, or both. A useful improvement to this kind of training would include equipment that gives the rider more options to vary the intensity of the pedaling required to continue. Along these lines, the rider needs bicycle accessories that adjust the resistance of tire revolution at the option of the rider and without being dependent upon the elevation of the travel path. Additionally, the bicycle training accessories could, at the option of the rider, be used to enhance a workout on a standard stationary bicycle trainer. The invention is set forth in the drawings herein as summarized below:

The invention encompasses a removable attachment for installing on a bicycle with the goal of altering the resistance to either front tire or back tire revolution. In this way, the bicycle includes enhanced physical training capabilities allowing the rider to use a bicycle on a standard trainer frame or as a regular bicycle for riding in the usual manner. In one embodiment, the attachment includes a resistance support connected to a bicycle and supporting a resistance device that engages a bicycle wheel or bicycle tire for altering the resistance to tire revolution. In this exemplary embodiment, the apparatus includes a resistance support attached to the bicycle proximate a bicycle tire along with a resistance device removably attached to the resistance support. In one embodiment, the resistance device defines a slot, and the resistance support projects through the slot to position the resistance device against the bicycle wheel or the bicycle tire.

In a different example, the invention includes the resistance support defining a groove or slot and the resistance device attached to the slot.

The resistance devices disclosed herein are interchangeable among themselves and attach to interchangeable resistance support devices. The resistance support devices may be positioned for associating with either the front tire or the back tire and may engage numerous points on the bicycle including but not limited to the seatstay, the down tube, the seat tube, and the like.

DETAILED DESCRIPTION

This detailed description includes certain terms that are related to bicycle parts (or "bicycle anatomy") that are commonly known in the art of bicycles. Terms related to bicycles and bicycle trainers are given their broadest ordinary meaning. A bicycle according to this invention encompasses a two wheeled machine with handle bars, a seat, pedals, a chain, and other normal parts of the everyday bicycle. The invention disclosed herein may be used with a bicycle trainer frame that allows a user to attach his or her own bicycle to the frame to simulate riding conditions. The invention also encompasses embodiments that are attached to a bicycle that is ridden in a normal way, such as a road bike or trail bike.

A bicycle typically consists of two wheels having respective rims for attaching respective bicycle tires. The bicycle tires have a road surface for engaging the road and side walls that extend when inflated. A bicycle in accordance with this invention includes commonly known standard parts (i.e., a seat, handle bars, brakes, break levers, gears, a chain, spokes, and the like). Other parts of a bicycle are useful for attaching a resistance support there to and are known by terms that are commonly known by those skilled in the art of bicycles. In this regard, this specification includes terms for bicycle parts that should be given their broadest meaning in line with common usage in the art of bicycles. For instance, a bicycle includes a seat post holding the saddle or seat. The seat post is connected to a downwardly extending seat tube connected proximate the pedals. A seat stay extends toward the rear tire from the seat post toward the rear axle. On the front end of the bicycle, a stem connects the handlebars to a top tube that extends from the handlebars to the seat post. A head tube connects the front axle to the top tube, and a down tube extends from the head tube toward the pedals. All of these bicycle anatomy terms are listed for example only, and these terms are intended to have their broadest meaning in terms of actual position and use in a bicycle structure.

The term bicycle trainer is used in its broadest sense to include all kinds of devices that individuals use to simulate bicycle riding conditions with a bicycle. A bicycle trainer often has a trainer frame that is stable on a support surface and lifts a rear tire of a bicycle off the floor while allowing the bicycle pedals to rotate the tire. A bicycle trainer often has a mechanism that adjusts the resistance to bicycle pedaling (i.e., a cylinder or roller against which a rear tire presses).

Figure 1:
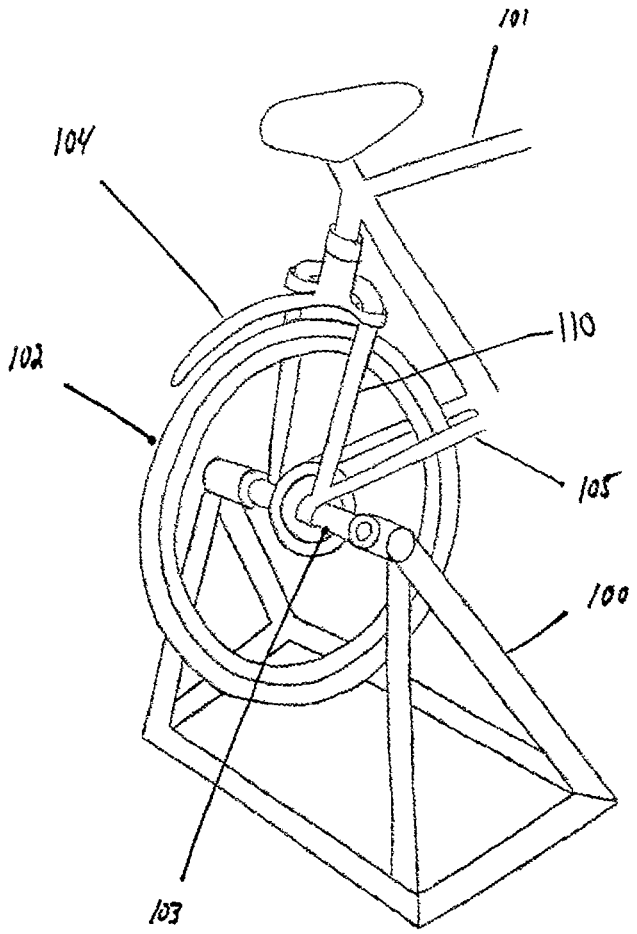
FIG. 1 is a perspective view of a rear tire of a standard bicycle elevated on a bicycle trainer and having a resistance support extending from the seat stay connected to the rear forks.

FIG. 1 shows a standard bicycle having a bicycle frame 101 that can engage a bicycle training stand 100 to elevate the bicycle for training in a stationary setting. The bicycle includes standard parts in the form of a rear tire 102 on a rear tire axle 103 connected to a chain-stay 105. In today's training equipment, the training stand 100 includes a cylinder engaging the rear tire of the bicycle to vary resistance to pedaling. The invention herein, however, changes that standard set up to attach resistance enhancing accessories to the bicycle itself. The predominant tool for enhancing resistance in FIG. 1 is the resistance support 104. The resistance support is adapted to receive resistance enhancing equipment, or a resistance device, thereon at the option of the user without interfering with standard bicycle operation in any way. In this embodiment, the resistance device 120 would slide over the resistance support 104. The resistance devices 120 are described in more detail in turn below.

Figure 2:
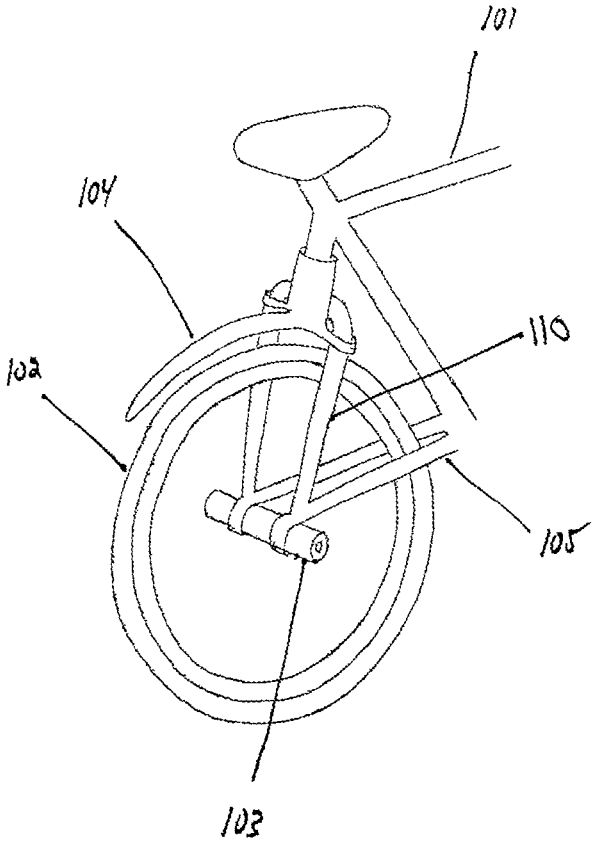
FIG. 2 shows an embodiment of the resistance support on a bicycle frame and allows for the bicycle to be ridden outside (i.e., not on a standard bicycle trainer).

FIG. 2 shows an embodiment of the resistance support 104 on a bicycle frame 101 and allows for the bicycle to be ridden outside (i.e., not on a standard bicycle trainer).

Figure 3:
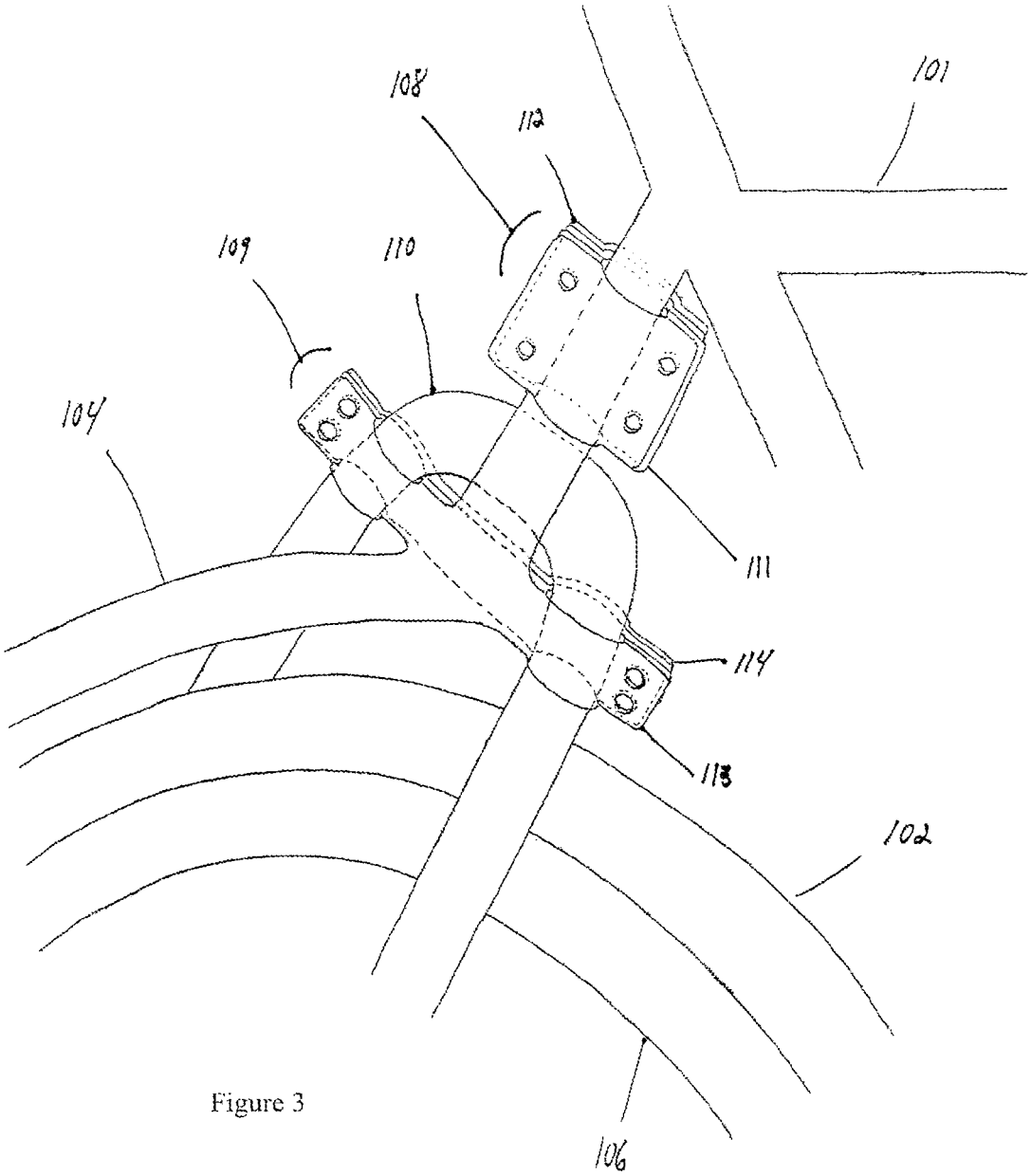
FIG. 3 is a perspective view of an exemplary bracketing system for holding a resistance support on the seat stay.

FIG. 3 shows a bracket set up for attaching the resistance support 104 to the bicycle frame, in particular the seat stay 110. The bracket consists of a top bracket 108 and a bottom bracket 109, each having a respective front face (112, 114) and rear face (111, 113). The bracket portions connect to one another around the seat stays 110.

Figure 4:
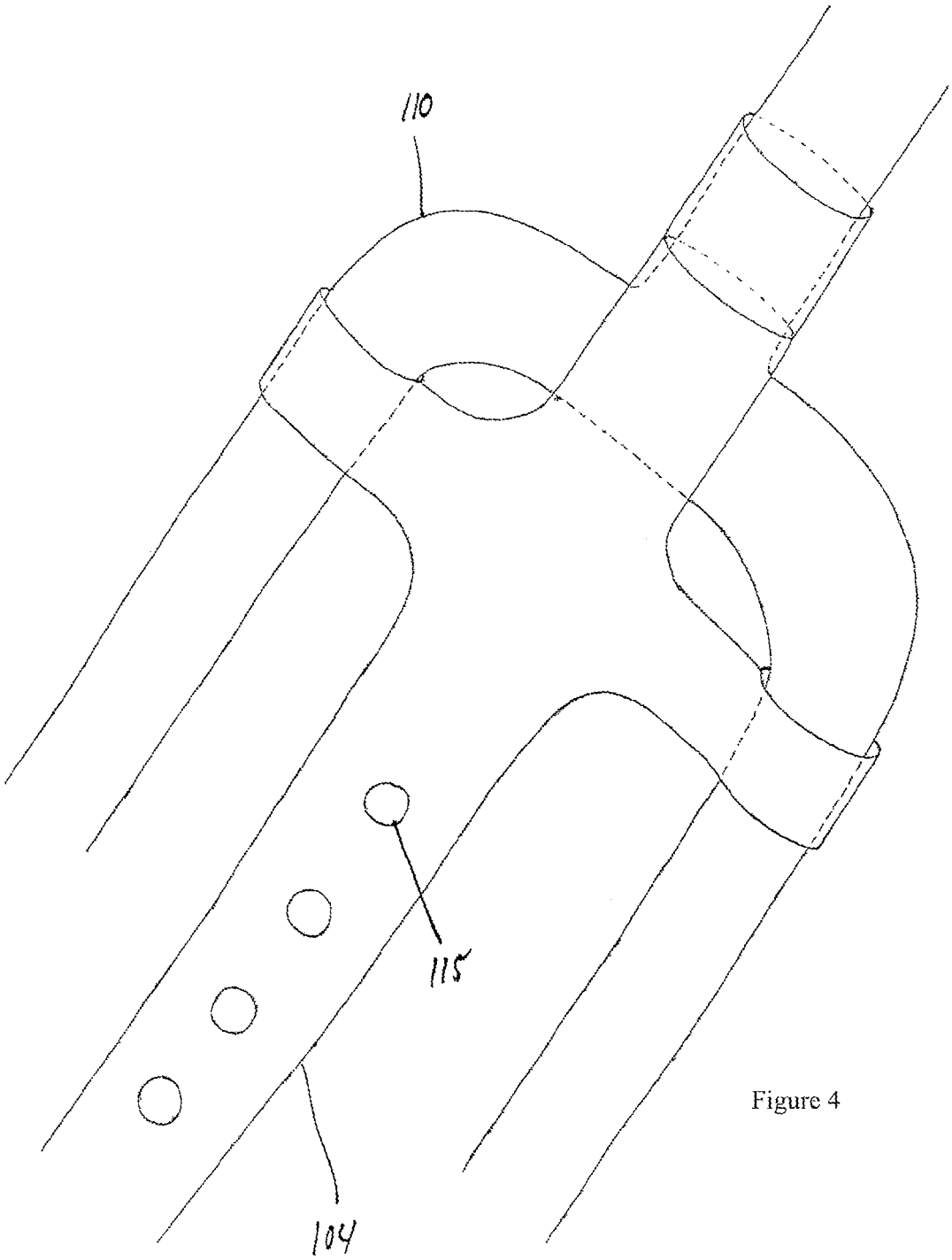
FIG. 4 is a top view of an exemplary resistance support having openings for attaching a resistance device.

FIG. 4 shows the resistance support 104 having attachment openings 115 that could receive a pin or other latch for attaching a resistance device 120 to the prong-shaped resistance support 104.

Figure 5:
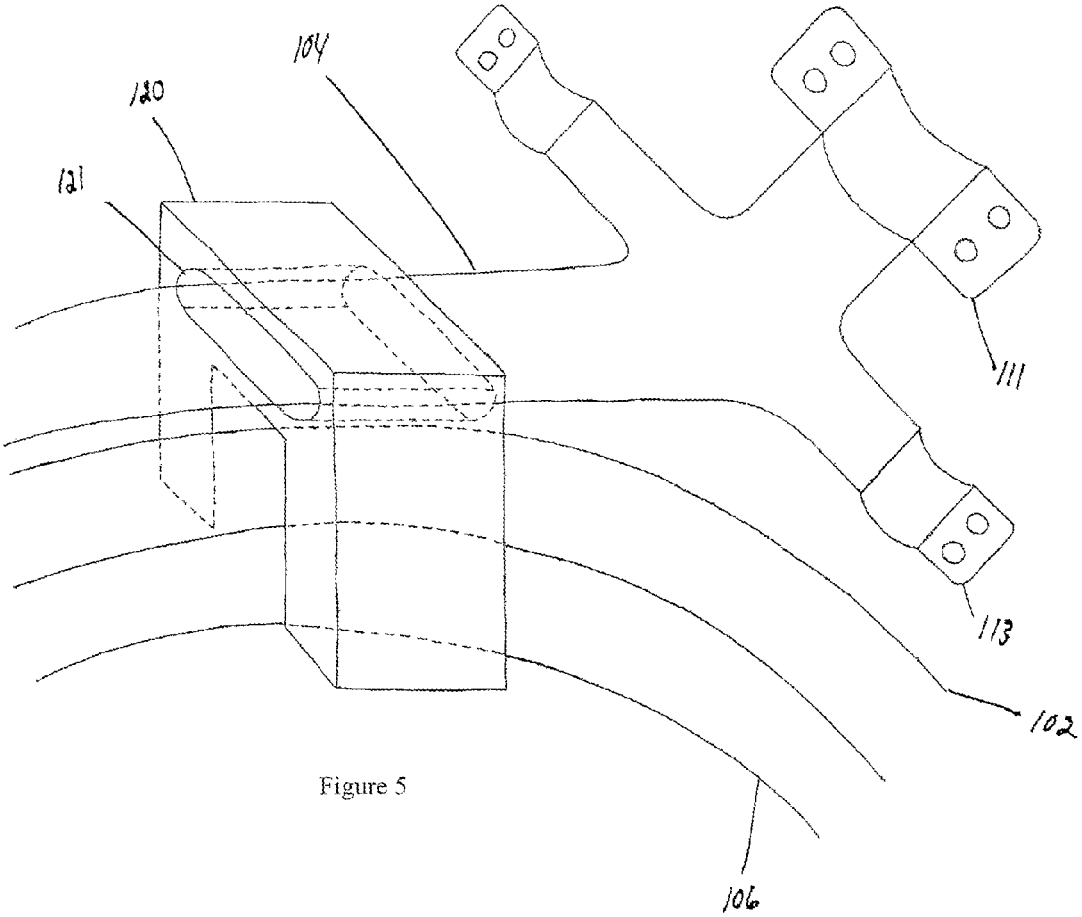
FIG. 5 is a side view of one kind of resistance device sliding onto a resistance support.

FIG. 5 shows one embodiment of a resistance device 120 that fits about the resistance support 104 attached to the bicycle frame. The resistance support 104 holds the resistance device 120 in a particular orientation relative to the rear tire 102 of the bicycle. This particular resistance device 120, which does not limit the invention in any way is only shown as an example, is especially useful for providing resistance to pedaling in conjunction with a magnetic sleeve attached to the rear tire. The resistance device, therefore, would provide a second magnetic force that engages a magnetic sleeve on the rear tire to adjust the resistance to pedaling.

Figure 6:
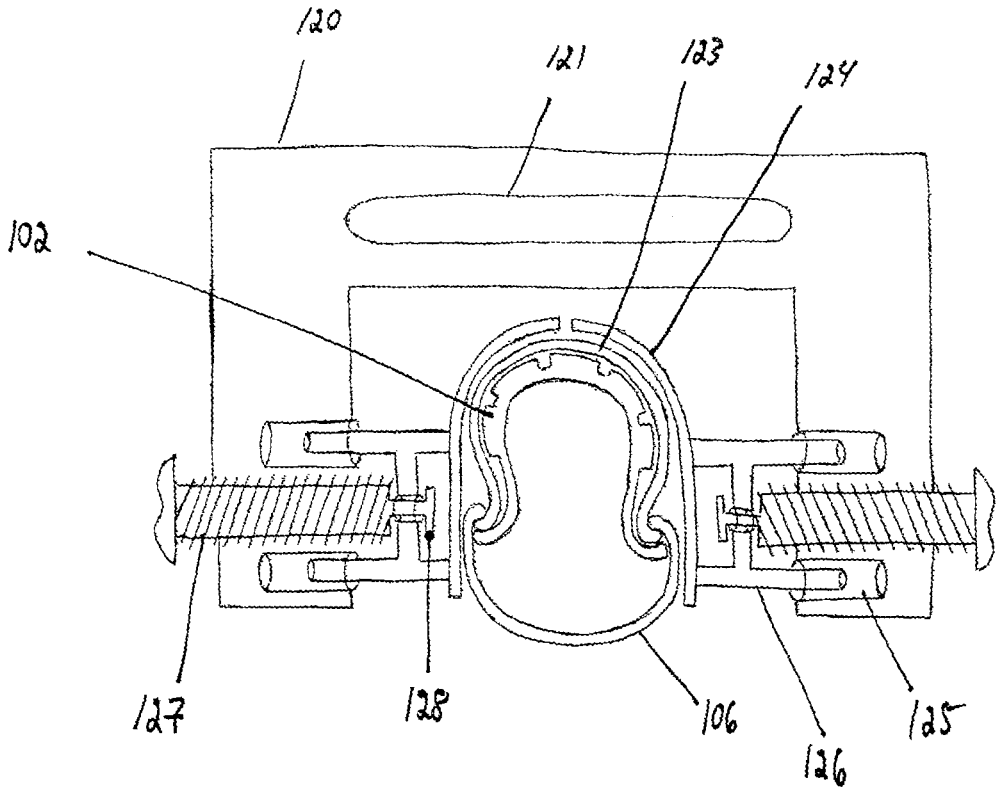
FIG. 6 is a cross section view of a resistance device according to the disclosure herein.

FIG. 6 shows more details regarding a resistance device 120 of FIG. 5, including an outer housing and a slot 121 for sliding over the resistance support 104. A magnetic plate 124 would provide the above described second magnetic field for use with a sleeve on the rear tire having a first magnetic field. See prior noted U.S. Pat. No. 7,955,228, incorporated herein in its entirety, for more details regarding the magnetic sleeve. As seen in prior embodiments set forth in the '228 patent by this same inventor, a bicycle tire may be composed of a slot for placing a removable strip with a magnetic inner portion that fits within the slot. In a preferred embodiment, the strip fitting within the tire slot is further characterized by a rubber coating intended to engage the road during use. The magnetic plate 124 of the resistance device 120 is held in place by a magnetic plate bracket (H-shaped) 126 that fits within hollowed portions of the resistance device for accurate plate positioning around the tire. An adjustable screw 127 controls proximity of the magnetic plate with the magnetic sleeve. The adjustable screw 127 has interior threading to receive a counter screw 128 holding the H-shaped bracket in place. Channels 125 in the outer housing of the resistance device 120 receive the outer legs of the H-shaped bracket 126.

Figure 7:
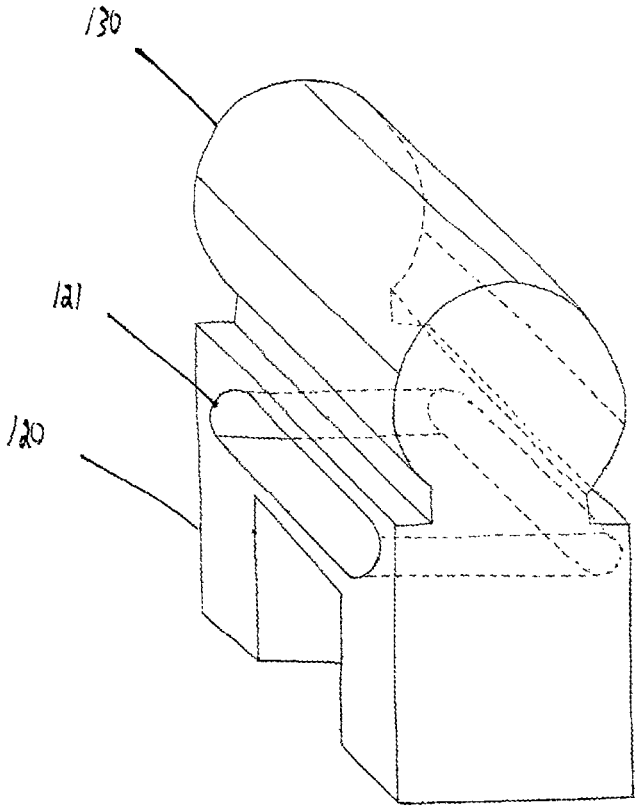
FIG. 7 is a perspective view of a resistance device including a battery housing for use with an electromagnet according to the disclosure herein.

FIG. 7 is an overview of another resistance device 120 that fits on the resistance support 104 and includes a battery housing 130 for use with electromagnetic trainers discussed in the above noted prior U.S. Pat. No. 7,955,228.

Figure 8:
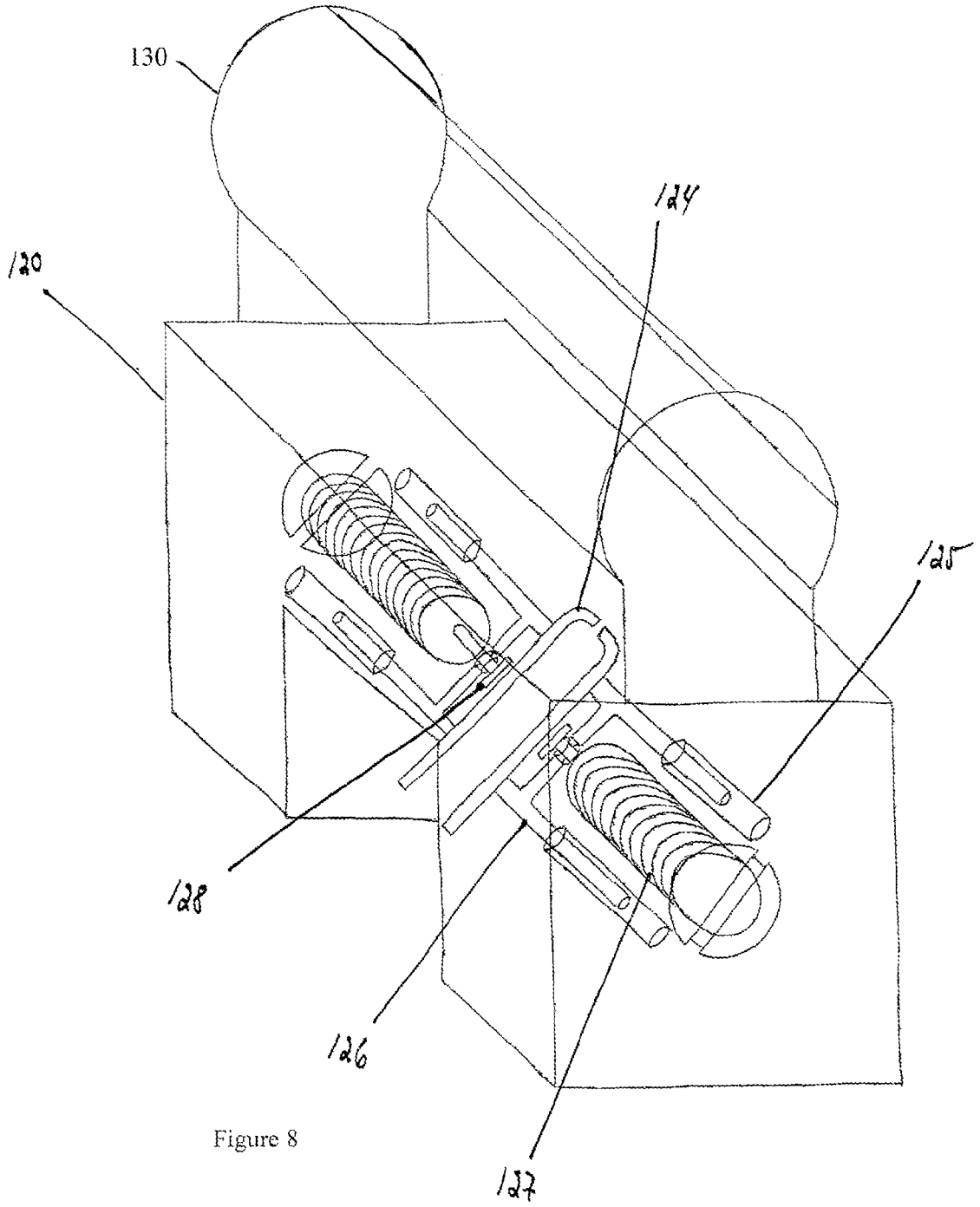
FIG. 8 is a perspective view of a resistance device having adjustable tension according to the disclosure herein.

FIG. 8 is an overall combination of FIGS. 5-7 and shows a resistance device 120 that slides over the resistance support 104 and provides for magnetic portions 124 to surround a bicycle tire.

Figure 9:
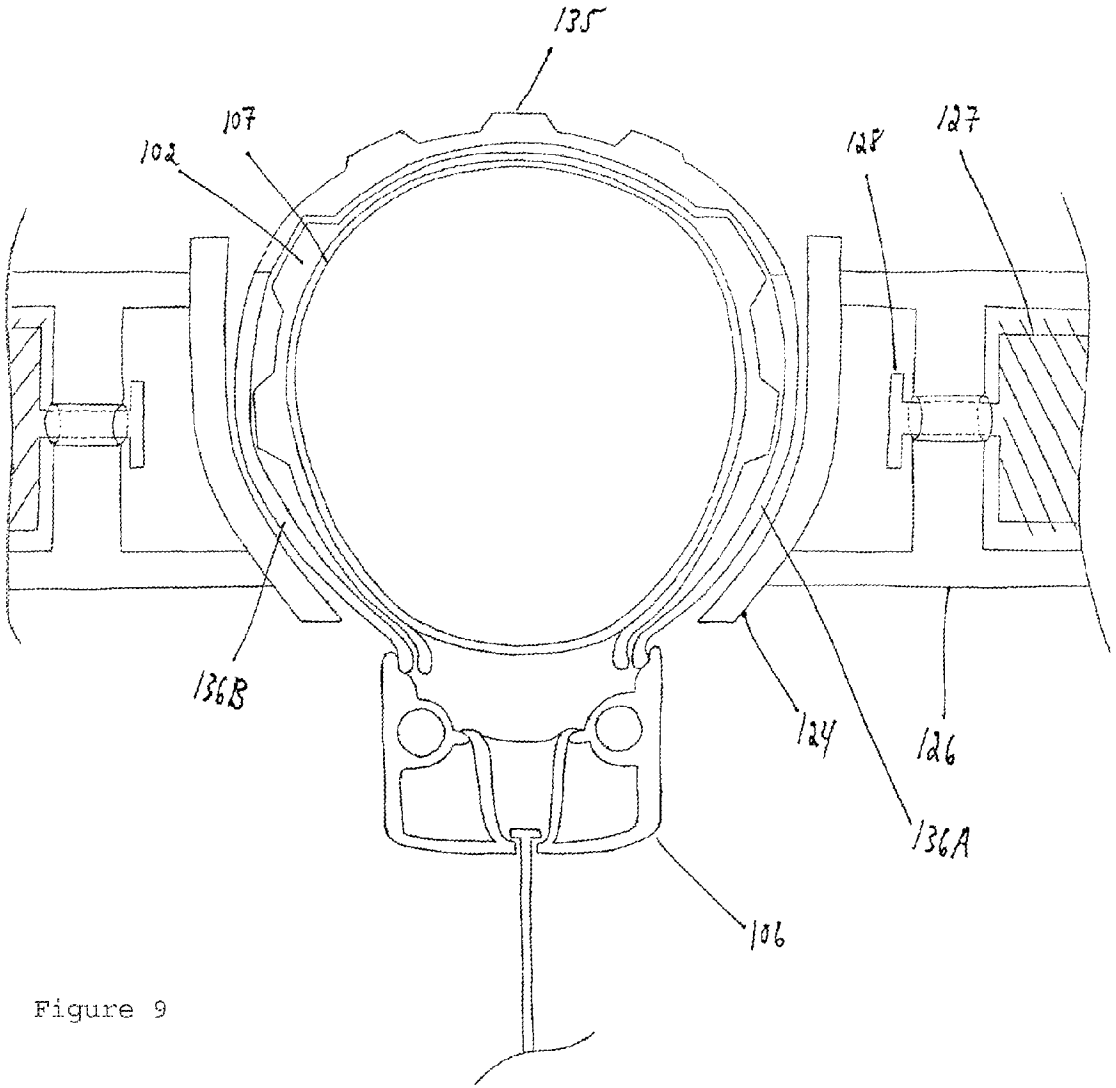
FIG. 9 is a cross section view of a resistance device utilizing magnetic resistance according to the disclosure herein.

FIG. 9 is an embodiment of a new trainer used for riding on a road or track outside and incorporating the resistance modulating devices 104 described above. The embodiment of FIG. 9 is particularly suited for use with slotted tire embodiments set forth in prior patent applications (e.g., Ser. No. 12/725,654 incorporated herein by reference) and described above. In the drawing of FIG. 9, a magnetic plate 124 is in electromagnetic communication with a magnetic portion of a slotted tire receiving a magnetic sleeve around the tire. The sleeve has magnetic side panels 136A, B for electromagnetically engaging the magnetic plate 124 and a rubberized section 135 that the rider can use on the road. In a different embodiment utilizing the same magnetic plates 124, the magnetic portion of the bicycle tire may be incorporated into the tire itself (102). In this regard, the cross section of the tire 102 would show a layer of magnetic material (e.g., a magnetic film) surrounded by adjacent layers of rubber for contacting the inner tube 107 on one side and the road on the opposite side.

Figure 10:
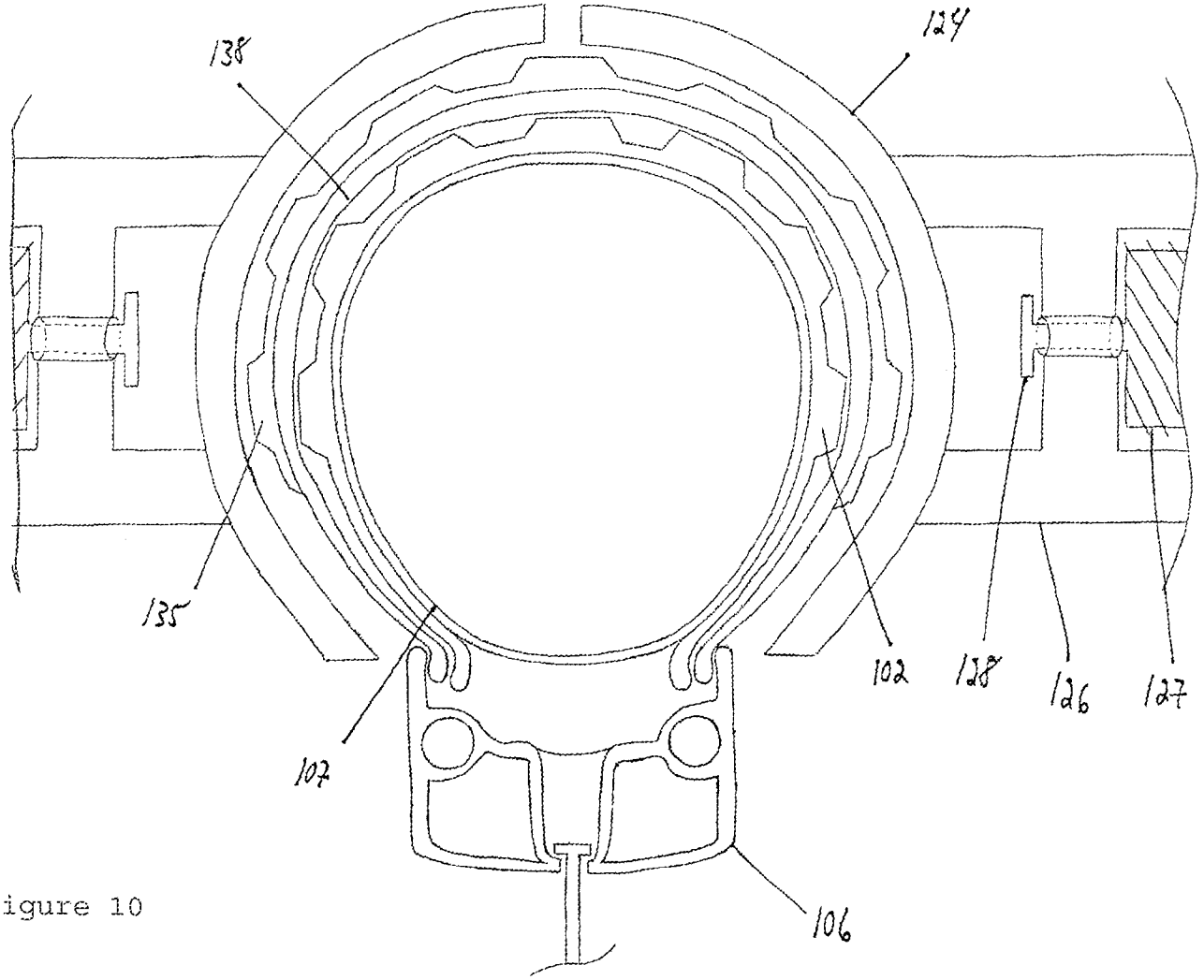
FIG. 10 shows a cross section of a resistance device utilized with a layered tire embodiment according to the invention herein.

FIG. 10 shows the combination of FIGS. 5-9 but the tire is circumferentially layered so that the magnetic portion of the tire is an inner layer 138. The tire has an outer rubber layer 135 for engaging the road.

Figure 11:
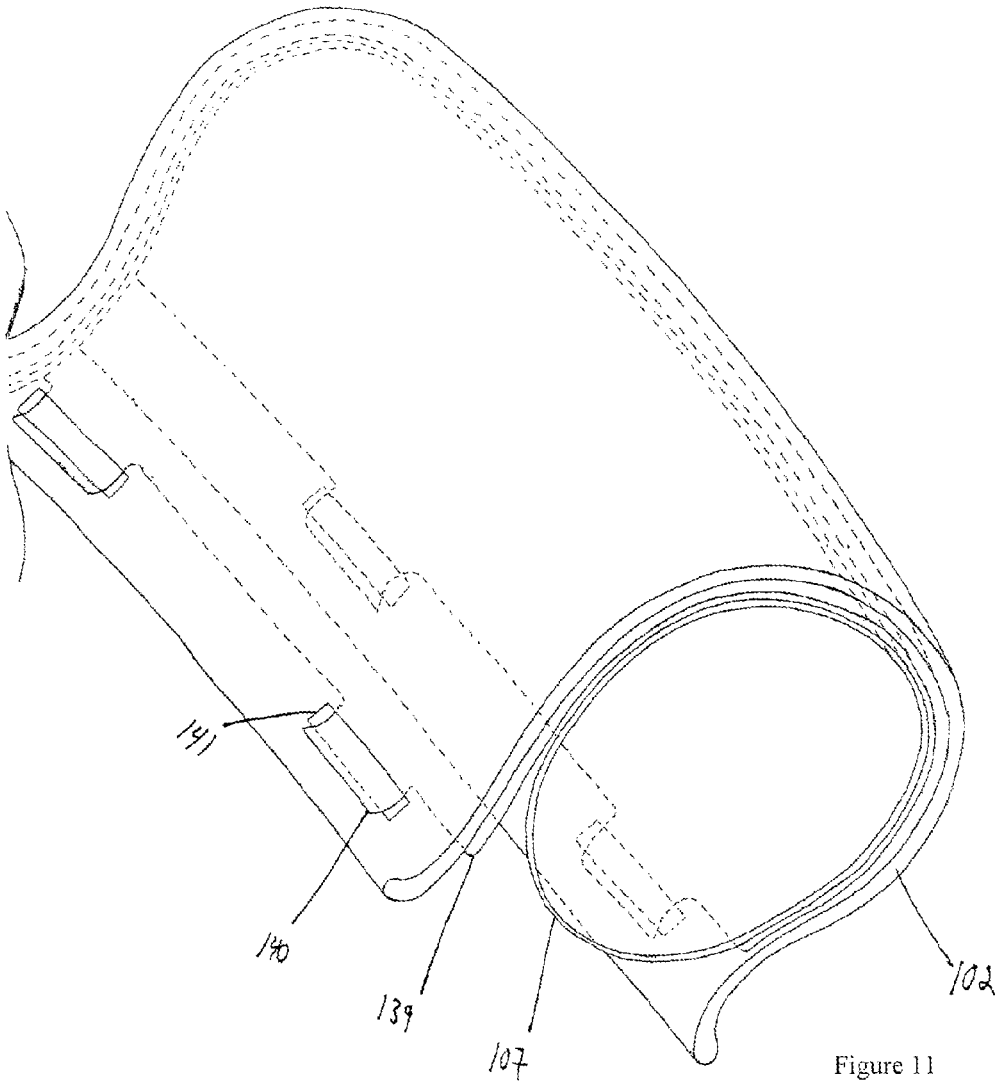
FIG. 11 shows an exemplary embodiment of a layered tire for use with the resistance device disclosed herein.
Figure 12:
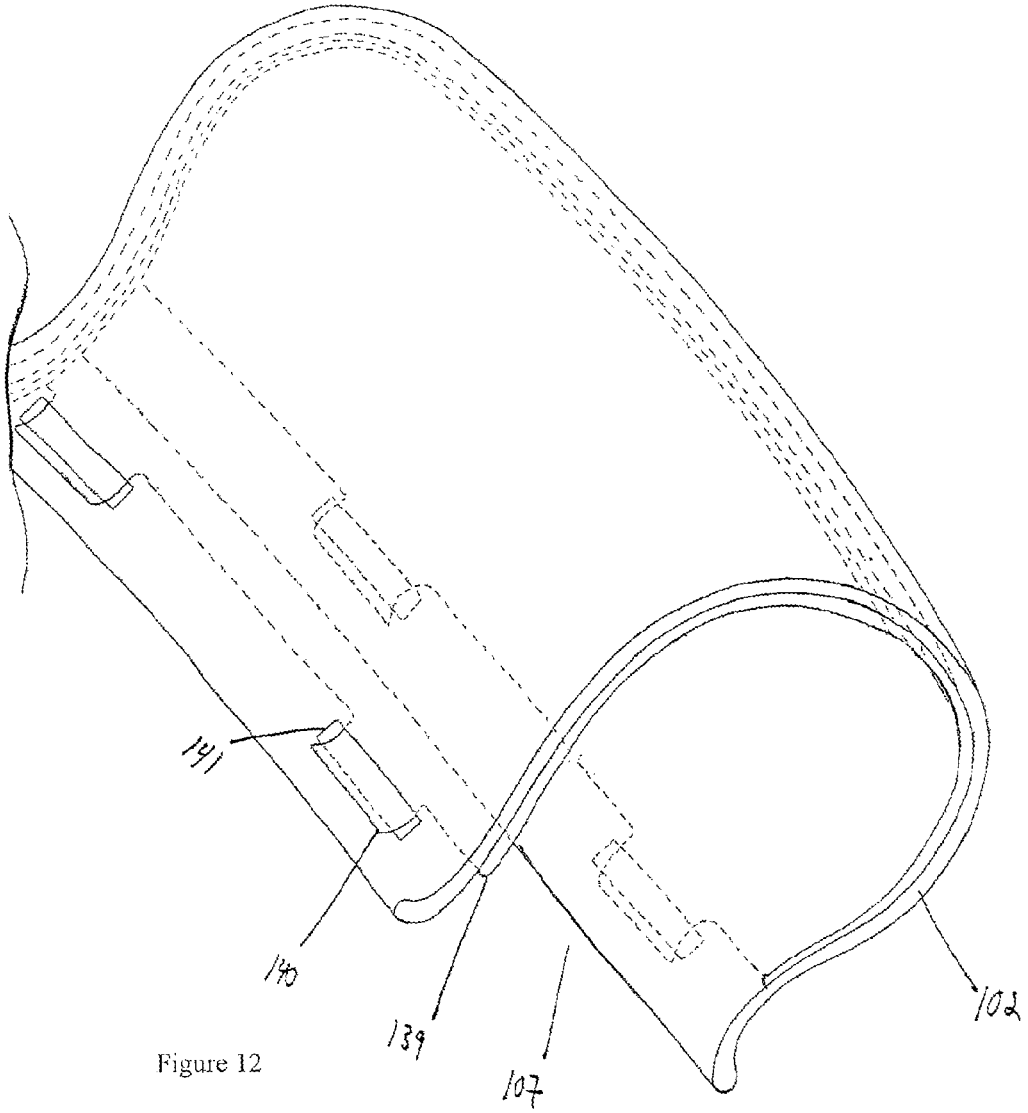
FIG. 12 shows a different view of the resistance device according to FIG. 11.
Figure 13:
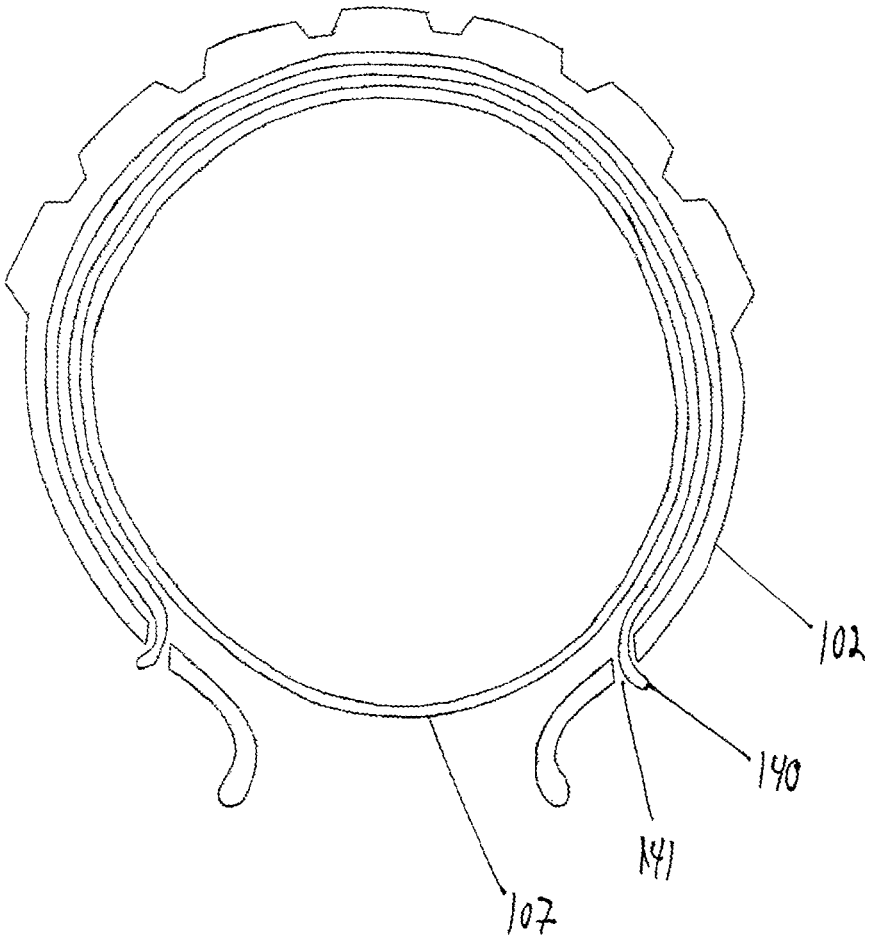
FIG. 13 is a cross section view of a layered embodiment of a tire used with a resistance device according to this disclosure.

FIGS. 11/12/13 shows yet another embodiment for providing a magnetic insert 139 to the tire as shown in cross section in FIG. 13. See also prior U.S. Pat. No. 7,955,228 incorporated entirely by reference herein. Reference 139 shows the magnetic layer between inner tube 107 and the tire 102. The magnetic layer 139 includes tabs 140 that fit within openings in the tire 141. The cross section is taken with the tabs extending through the openings 141.

Figure 14:
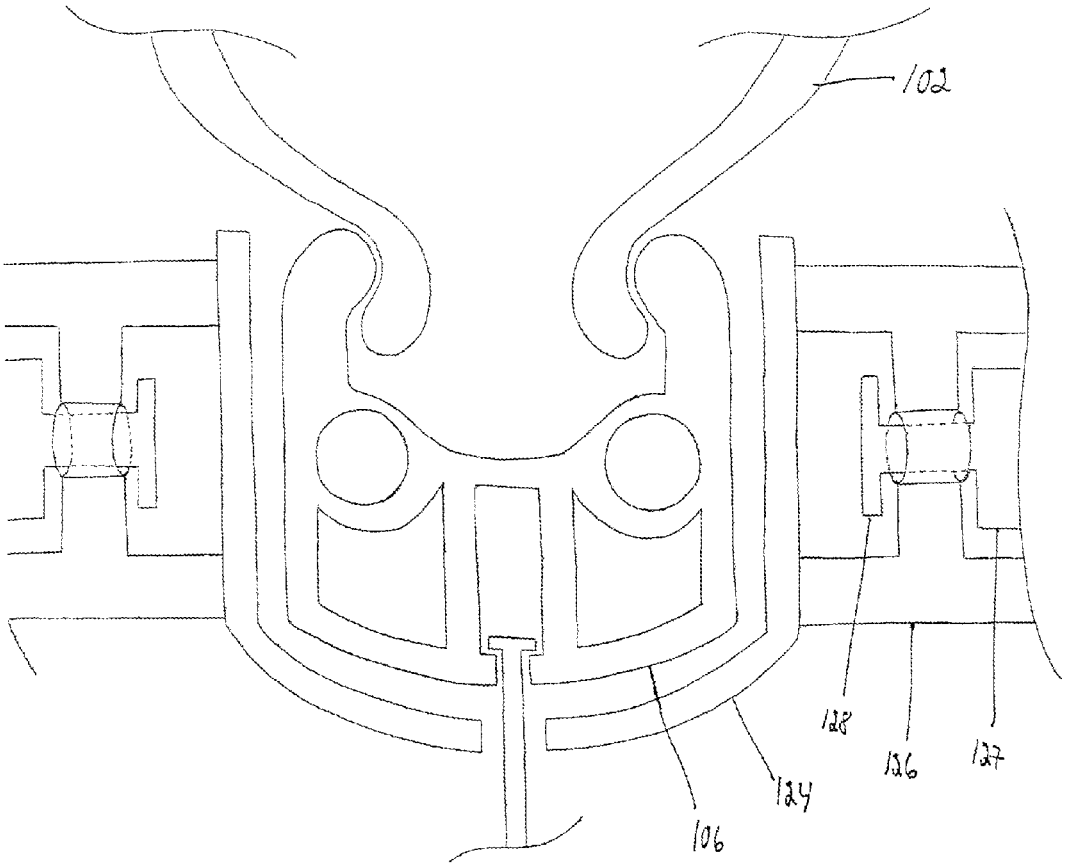
FIG. 14 shows a resistance device according to this invention and uses the bicycle wheel rim as a source of ferromagnetism.

FIG. 14 shows a way of using the bicycle tire rim 106 as a source of ferromagnetism. By making the rim 106 of a lightweight ferromagnetic material, the trainer body can be positioned adjacent the rim with the magnetic plate in sufficient proximity thereto for variable resistance to pedaling. The rim 106 would be positioned in proximity to the resistance device 120. The magnetic plate 124, the H-shaped magnetic plate bracket 126, adjustable screw 127, and counter screw 128 are all the same as described above.

Figure 15:
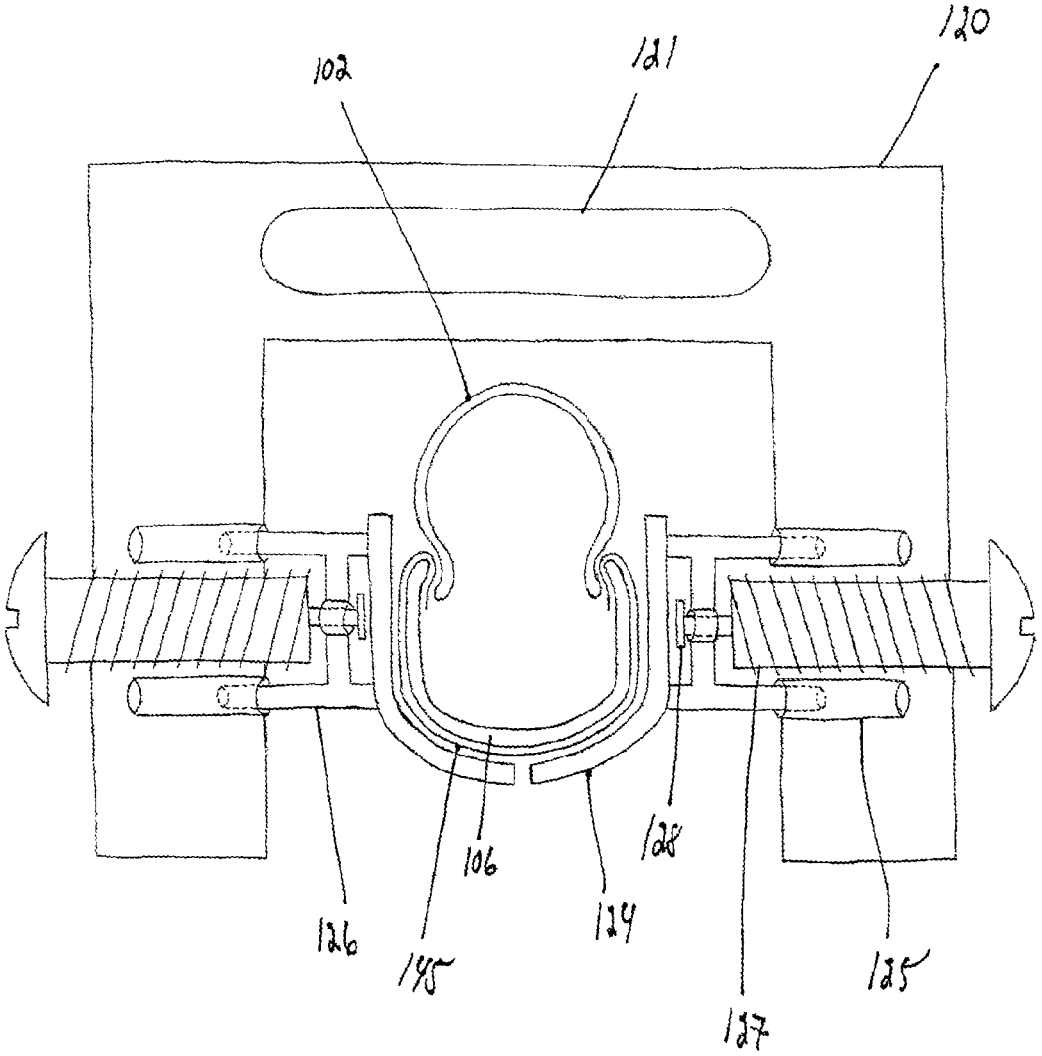
FIG. 15 shows cross section view of a magnetic clip that attaches to the rim of a bicycle wheel and allows for use of a magnetic resistance device according to this invention.

FIG. 15 shows an accessory for making a standard rim of a bicycle a ferromagnetic rim for use as shown in FIG. 14 above. The device of FIG. 15 incorporates a magnetic clip 145 that fits on a standard bicycle rim so that the clip electromagnetically engages the resistance device 120 via a magnetic plate 124. The resistance device is held in place on the resistance support 104 as described above.

Figure 16:
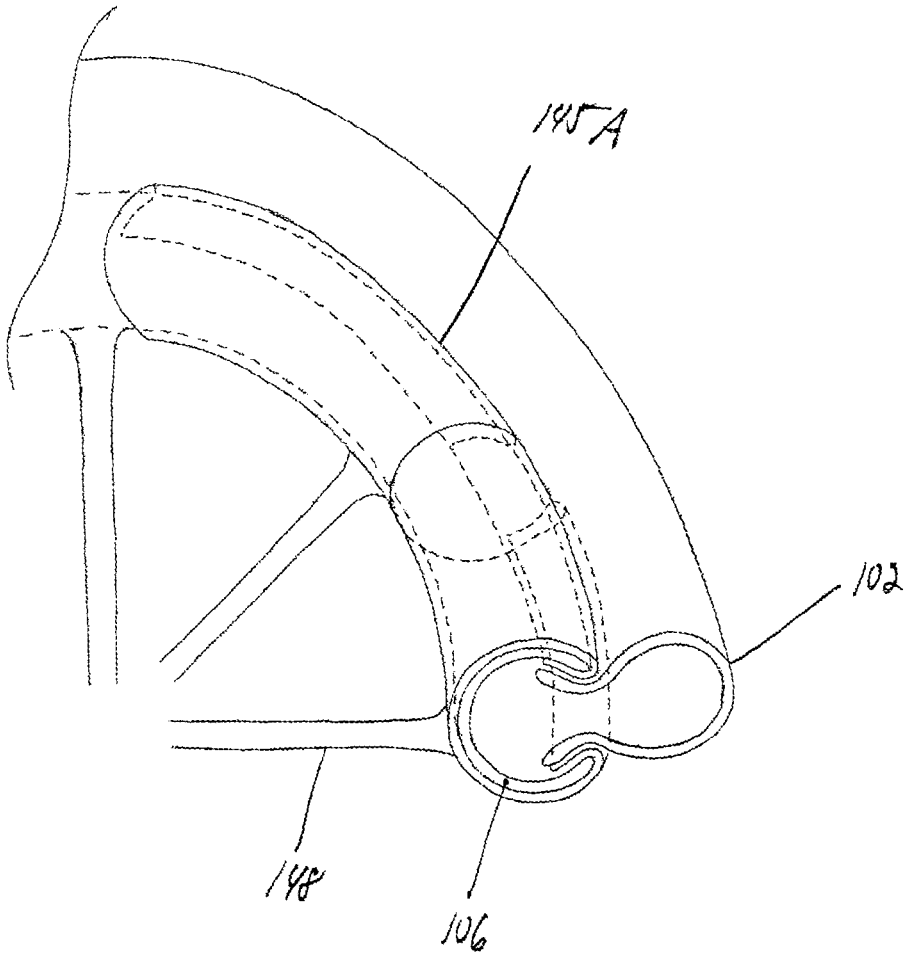
FIG. 16 shows a magnetic clip that crosses over the spokes of a standard bicycle wheel and allows for using a magnetic resistance device according to this invention.
Figure 17A:
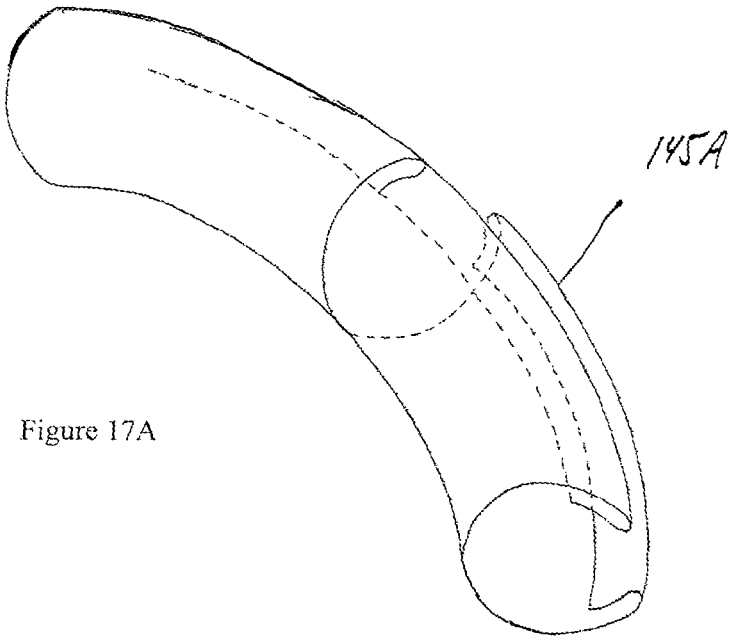
FIG. 17A shows a second segment of a magnetic clip that crosses over the spokes of a standard bicycle wheel according to the invention described herein.
Figure 17B:
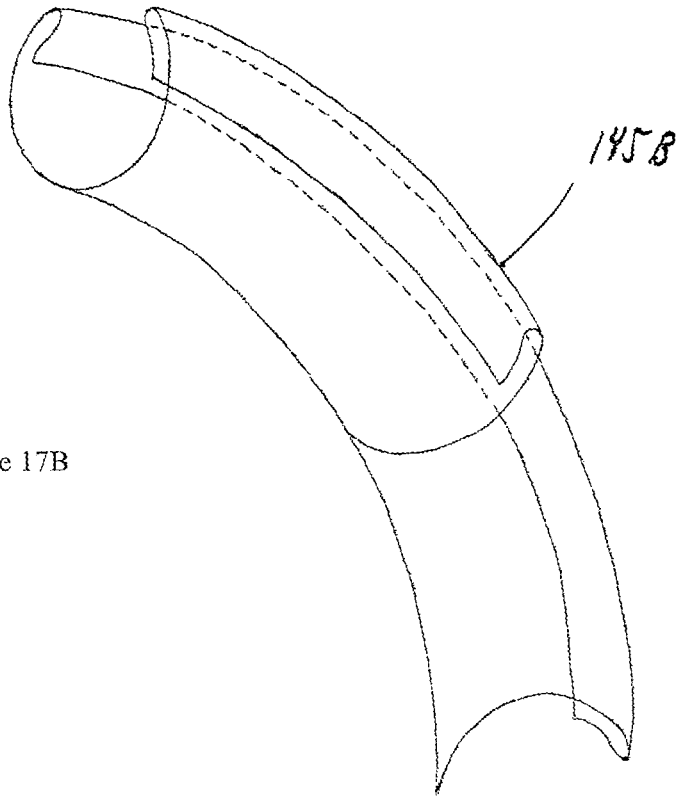
FIG. 17B shows a third segment of a magnetic clip for use with the segments shown in FIGS. 16 and 17A.
Figure 18:
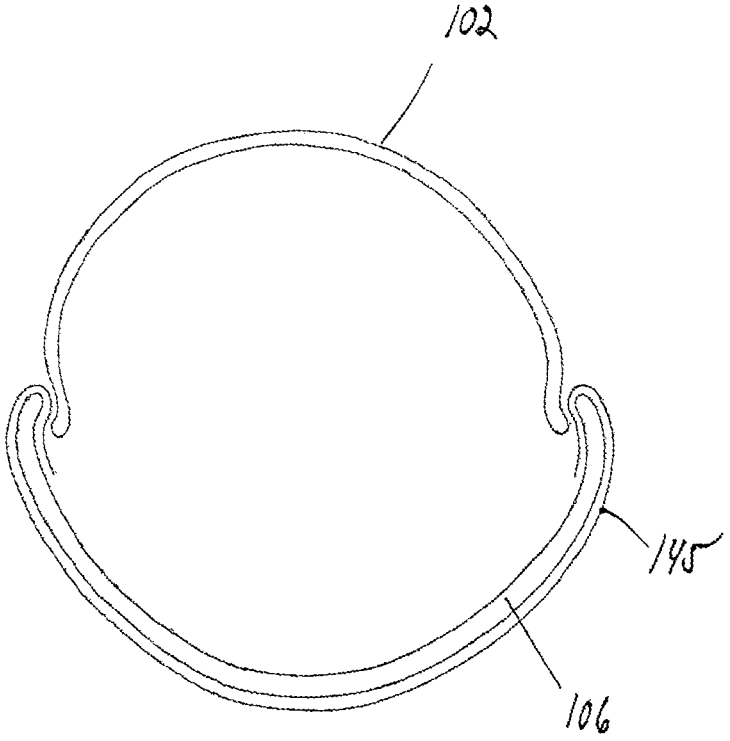
FIG. 18 shows a cross section of the magnetic clip segments of FIGS. 16, 17A, and 17B.

FIG. 16 shows a new kind of ferromagnetic clip 145 that crosses over the spokes of a bicycle wheel. The ferromagnetic clip of FIG. 16 is modular in that separate pieces engage the bicycle rim to avoid crossing over the associated spokes of the bicycle wheel. The magnetic clip of this invention has an abbreviated side 145A that fits over the rim up to the point of bracing against a first spoke extending from the rim to the bicycle tire axle. An associated section of the magnetic clip 145, referred to herein as a mating side 145B, continues around the first spoke until it extends up against a second spoke. The abbreviated sides 145A and mating sides 145B connect around the circumference of the bicycle tire rim, avoiding spokes accordingly. To accomplish this connection among abbreviated and mating sides (shown in detail in FIGS. 17 and 18), each portion has a section that extends approximately 270 degrees around a bicycle rim and then an extension that fits across the rim until it abuts a spoke. Then the next section has an extension fits on the other side of the spoke over the rim to match the first extension. The pattern continues until the entire rim is covered by a magnetic clip 145. FIG. 18 shows the cross section of the result.

Figure 19:
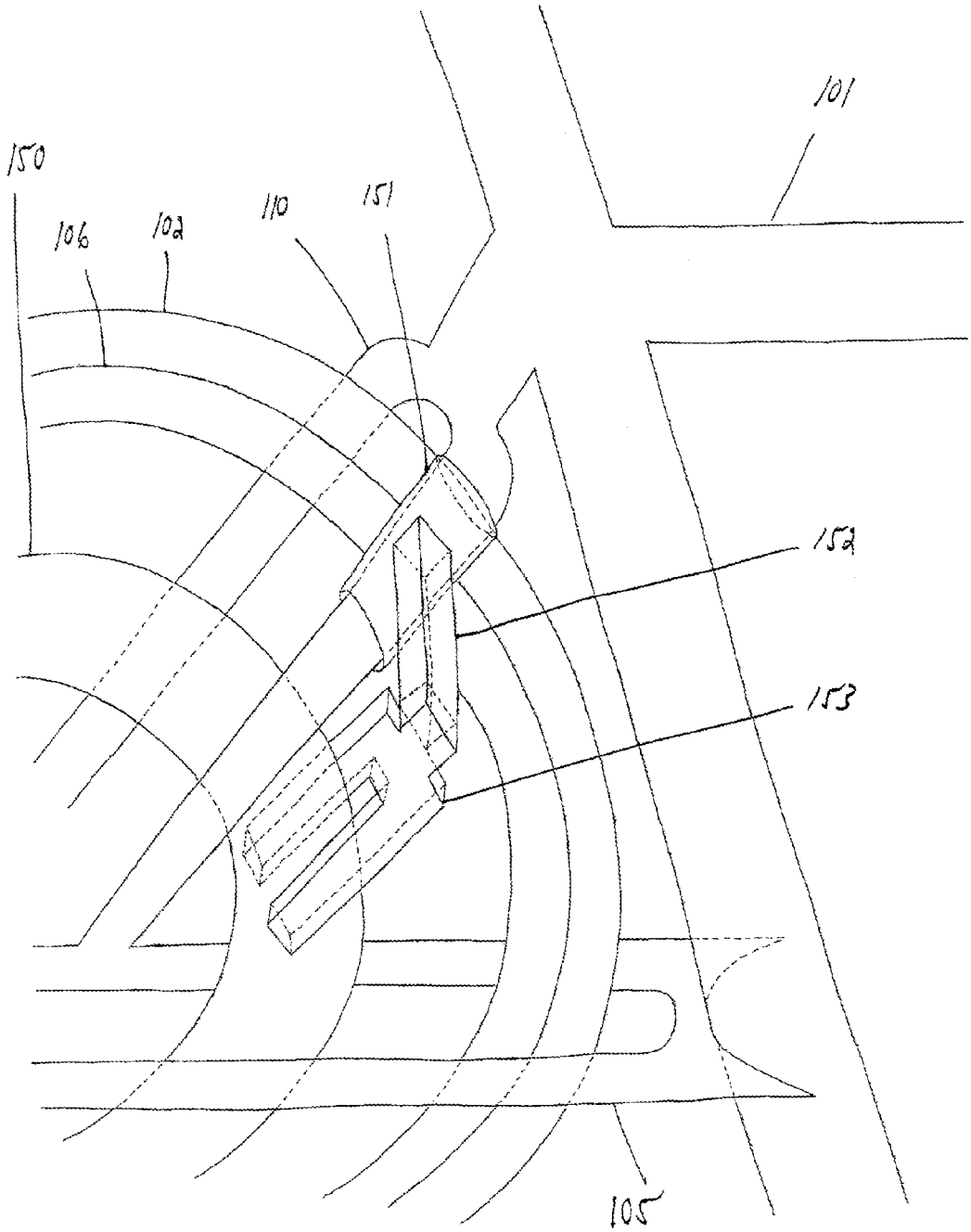
FIG. 19 shows a side view of a resistance device attached to the seat stay and incorporating sufficient magnetic force for use with a ferromagnetic disc brake.
Figure 20:
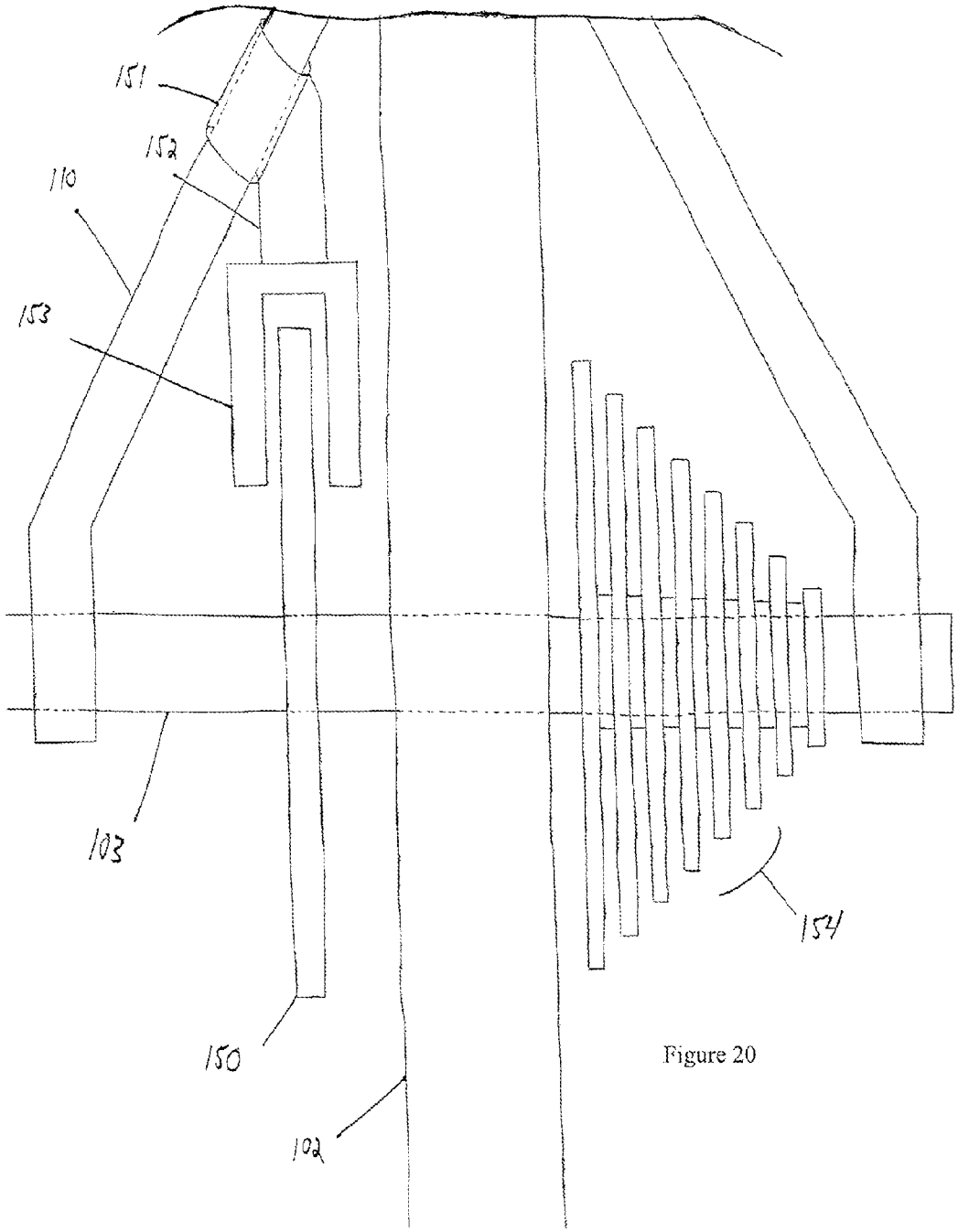
FIG. 20 shows a cross section view of the resistance device according to FIG. 19.

FIGS. 19-23 fit a magnetic resistance device 153 over a disk brake 150 which can be made of a ferromagnetic material. The clip 153 attaches via a support arm 152 that is connected to a seat stay 110. A seat stay attachment 151 holds the magnetic resistance device in position. This embodiment allows a U-shaped magnet 153 to surround the disc brake, providing a means of electromagnetically varying resistance to pedaling. The magnetic resistance device 153 is positioned so that it does not hinder operation of the gears and derailleur 154. FIG. 20 is an expanded rear view of the device shown in FIG. 19.

Figure 21:
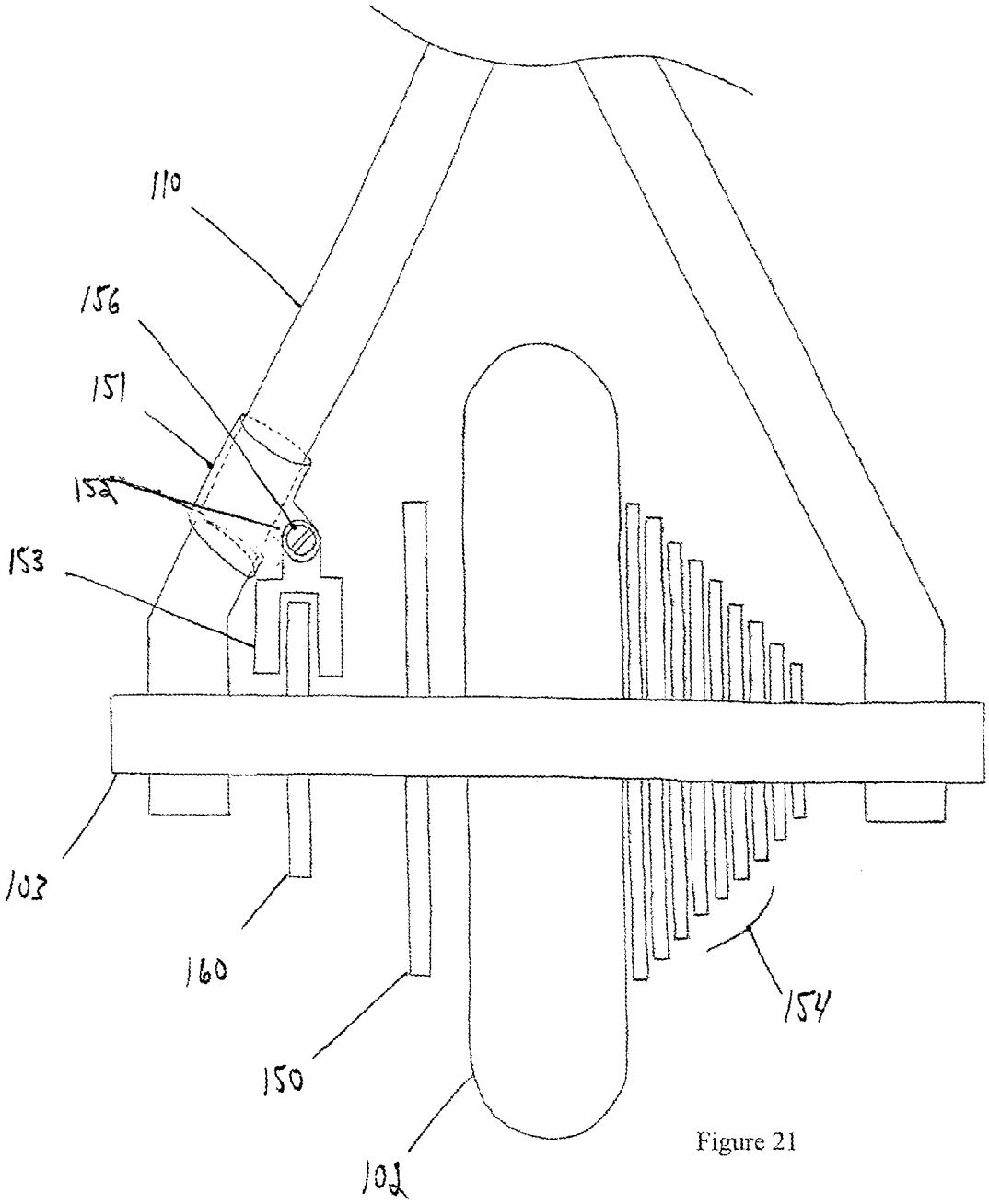
FIG. 21 shows a cross section of a resistance device according to FIG. 19 with the addition of a separate ferromagnetic resistance disc according to the disclosure herein.

FIG. 21 shows that the magnetic resistance device may be positioned via a pivot point 156. For those bicycles using a disc that is not ferromagnetic, this embodiment of the invention incorporates a second disc 160 onto the axle. The magnet 153 is positioned to be magnetically coupled to the second disc 160.

Figure 22:
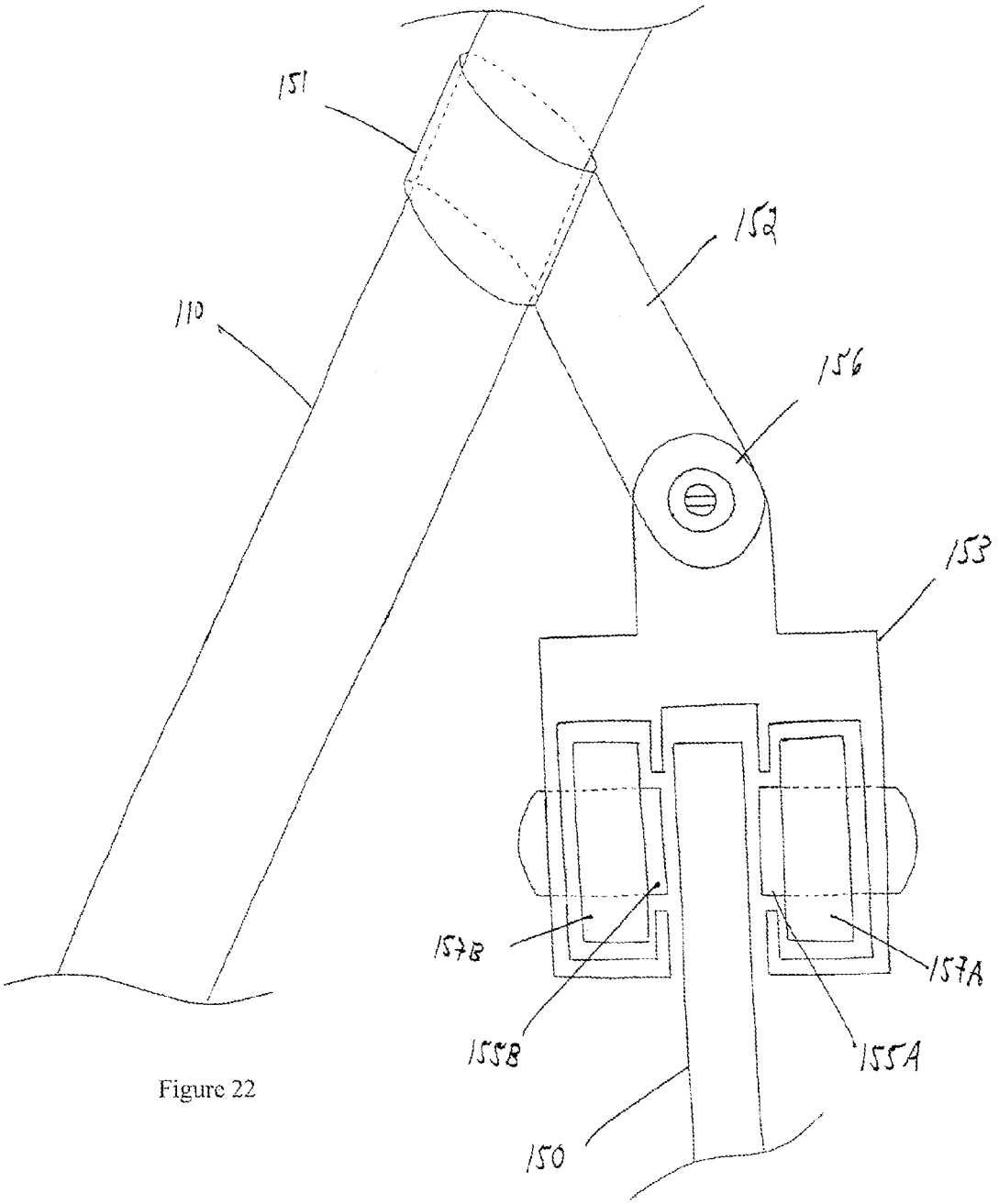
FIG. 22 shows a cross section of a disc brake embodiment of the invention with magnets integrated into the brake pad assembly.
Figure 23:
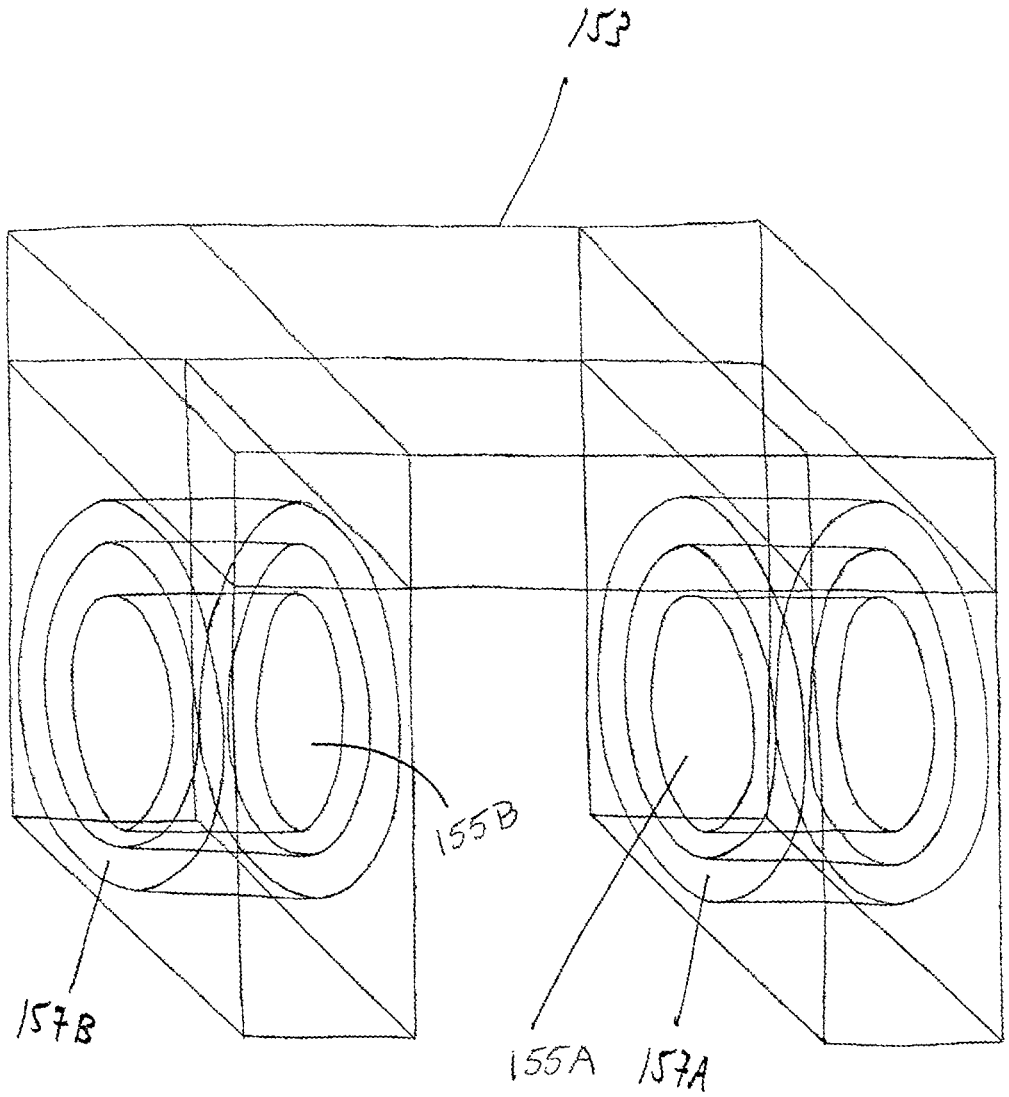
FIG. 23 is a perspective view of the magnets of FIG. 22.

FIG. 22 shows an embodiment of FIGS. 19-21 that allows for ferromagnetic components to optionally adjust the resistance to pedaling and further provide for disc brakes to fit within the same assembly. The figure shows brake pads 155A, 155B (dotted) fitting through an opening in respective vertically oriented magnets 157A, 157B. Again, the point is to provide magnets in proximity to currently used bicycle structures, such as a disc brake to control resistance to pedaling. FIG. 23 is a perspective view of the magnets of FIG. 22.

Figure 24:
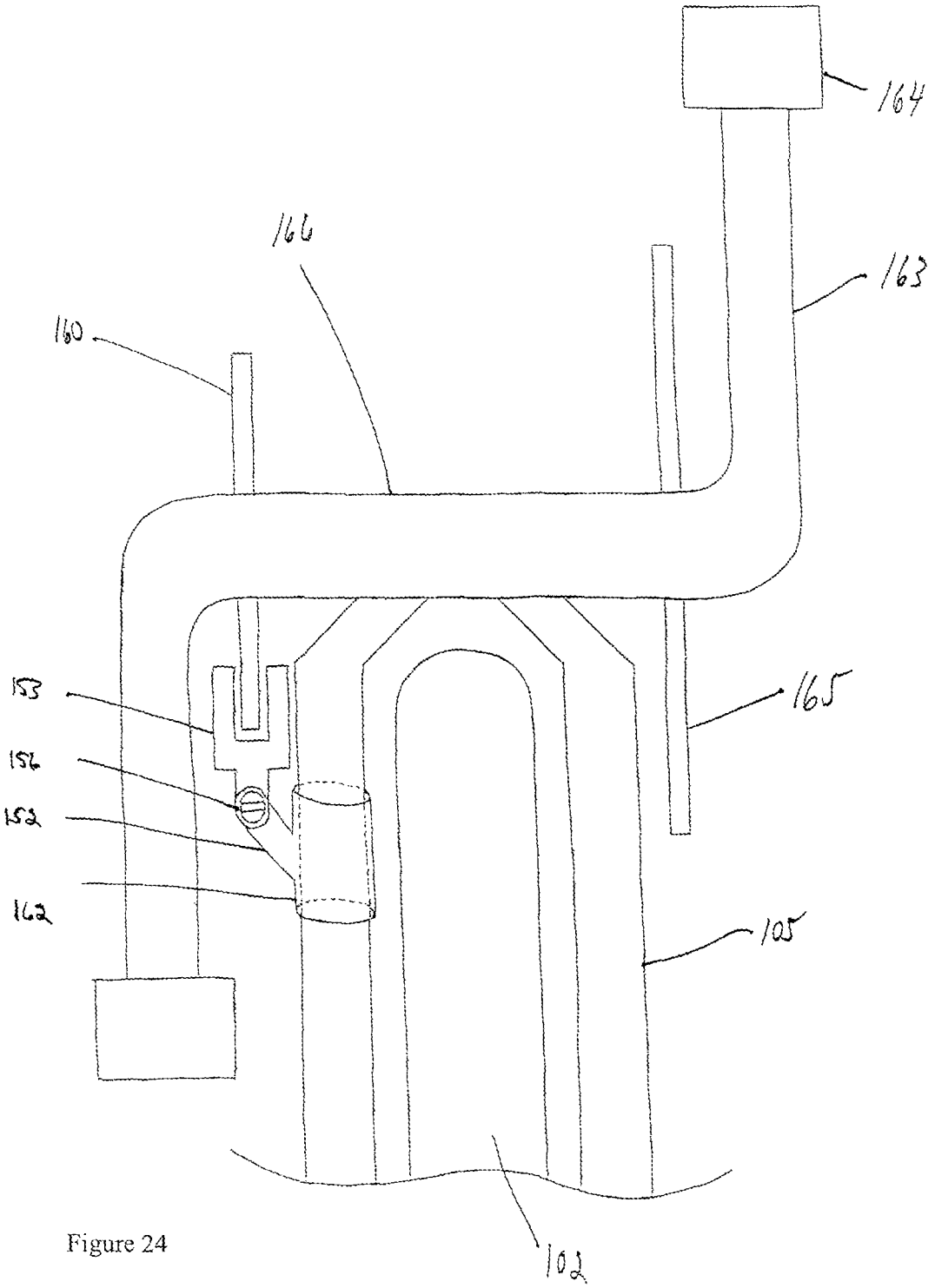
FIG. 24 shows a perspective view of a resistance device connected to the chainstay of a bicycle according to this invention.
Figure 25:
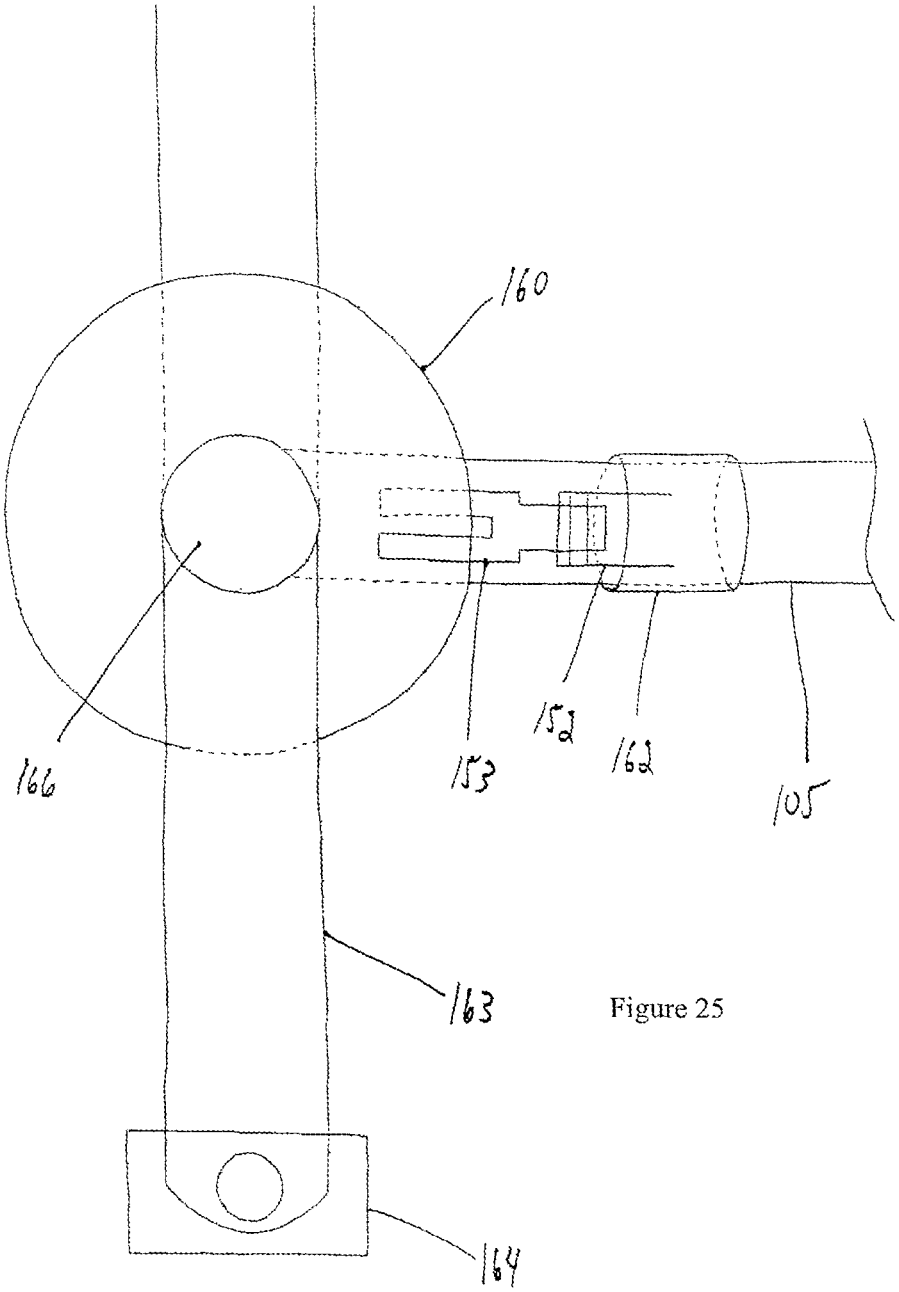
FIG. 25 shows a side view of the embodiment of FIG. 24.

FIG. 24 shows that a disk other than a disk brake may be made available on a standard bicycle to accomplish the goals of this invention in providing accessories that can be made available to add and subtract resistance to pedaling. FIG. 24 shows adding an electromagnetic pedal disk 160 to the cross bar 166 of a bicycle pedal assembly (pedals 164, crankarm 163). A magnet 153 is adjacent the disk 160. The magnet 153 is held in place in a way that is similar to above-described embodiments. In FIG. 24, the magnet 153 is held in place with a chainstay attachment 162. As used above, the magnet 153 is held in position by a support arm 152 and may further include a pivot point 156. FIG. 25 shows a side view of the pedal embodiment of FIG. 24.

Figure 25A:
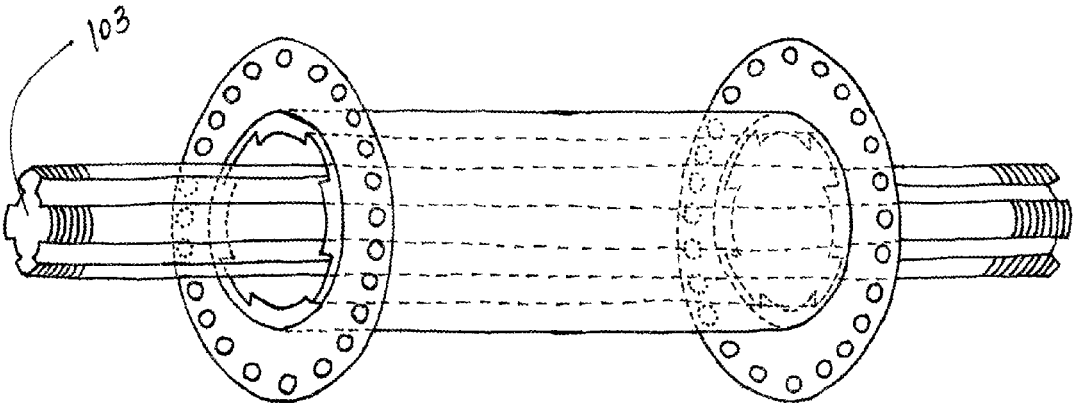
FIG. 25A shows a tire hub fitting around a ferromagnetic axle on a bicycle wheel.
Figure 25B:
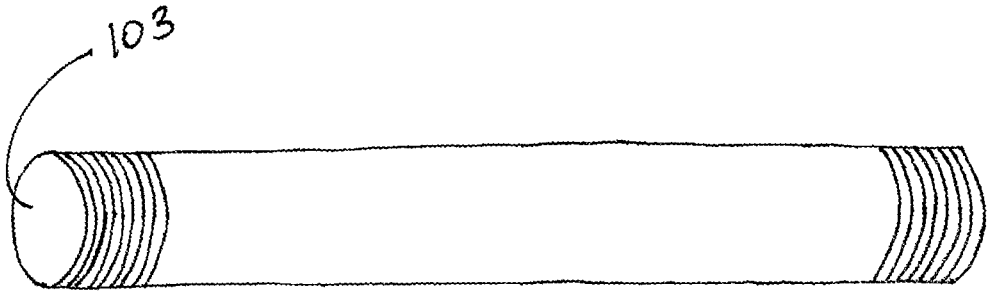
FIG. 25B shows a cross section of the embodiment of FIG. 25A.

FIG. 25A shows a tire hub fitting around an axle on a bicycle tire. The axle is ferromagnetic, and the hub has a magnetic cylinder lining the interior opening such that the axle interchangeably extends through the hub. Resistance to pedaling is determined by the extent of the magnetic field between the two components. An electromagnet embodiment could reasonably follow from this design.

FIG. 25 B is a cross section of FIG. 25A.

Figure 25C:
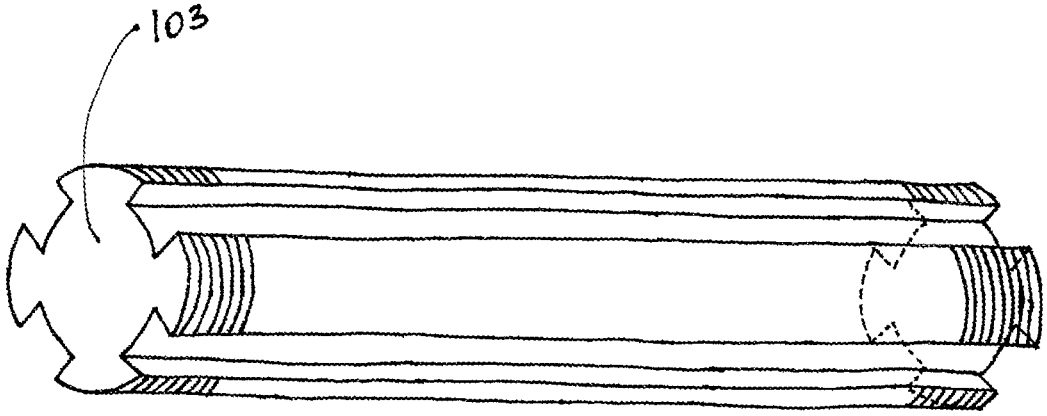
FIG. 25C shows an embodiment of the axle of FIG. 25 with the axle as a solid cylinder.

FIG. 25C shows that the axle can be a solid cylinder.

Figure 25D:
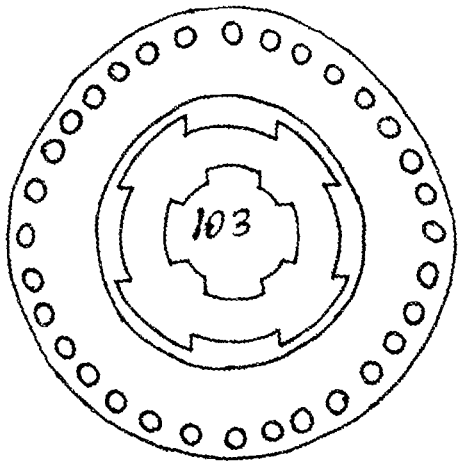
FIG. 25D shows an embodiment of the axle of FIG. 25 with the axle as a grooved structure for use with electromagnetic embodiments of the disclosure herein.

FIG. 25D shows that the axle could be grooved for an electromagnetic embodiment such that conductors extend within the grooves.

Figure 26:
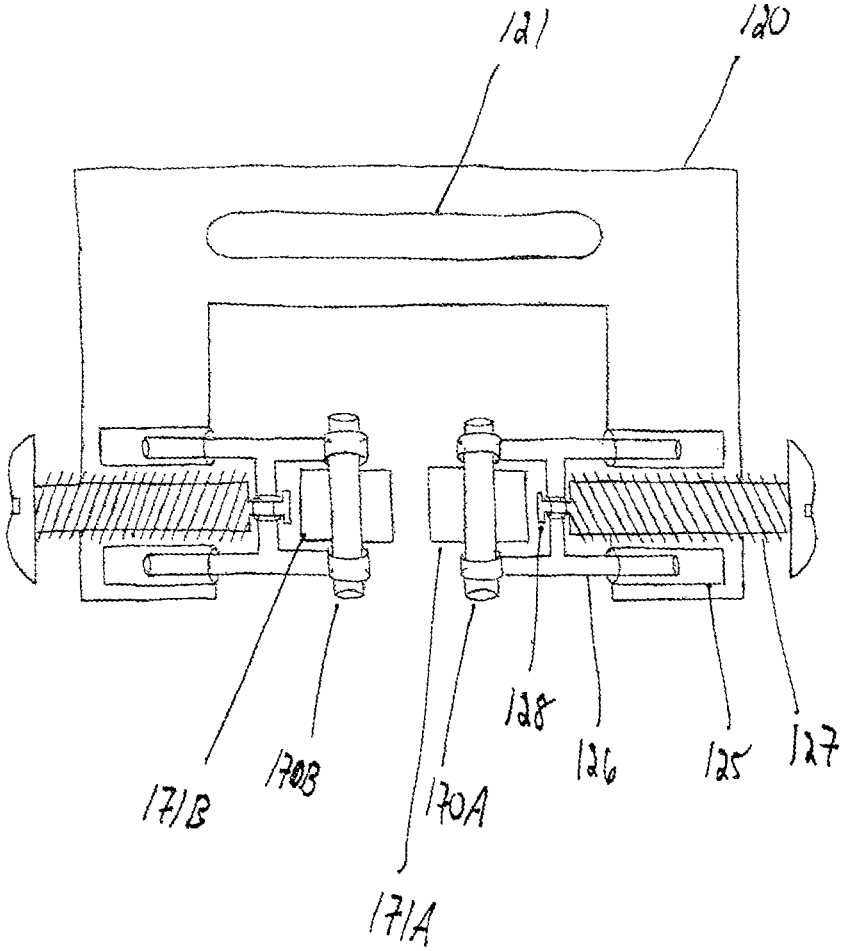
FIG. 26 shows a resistance device according to FIG. 5 with resistance rollers incorporated therein.

FIG. 26 shows yet another attachment that will be made available to the resistance support 104. In the embodiment of FIG. 26, the resistance is varied by rollers 171A and 171B that will engage the rim of an associated bicycle. The figures show similar structural points as noted in prior embodiments.

Figure 27:
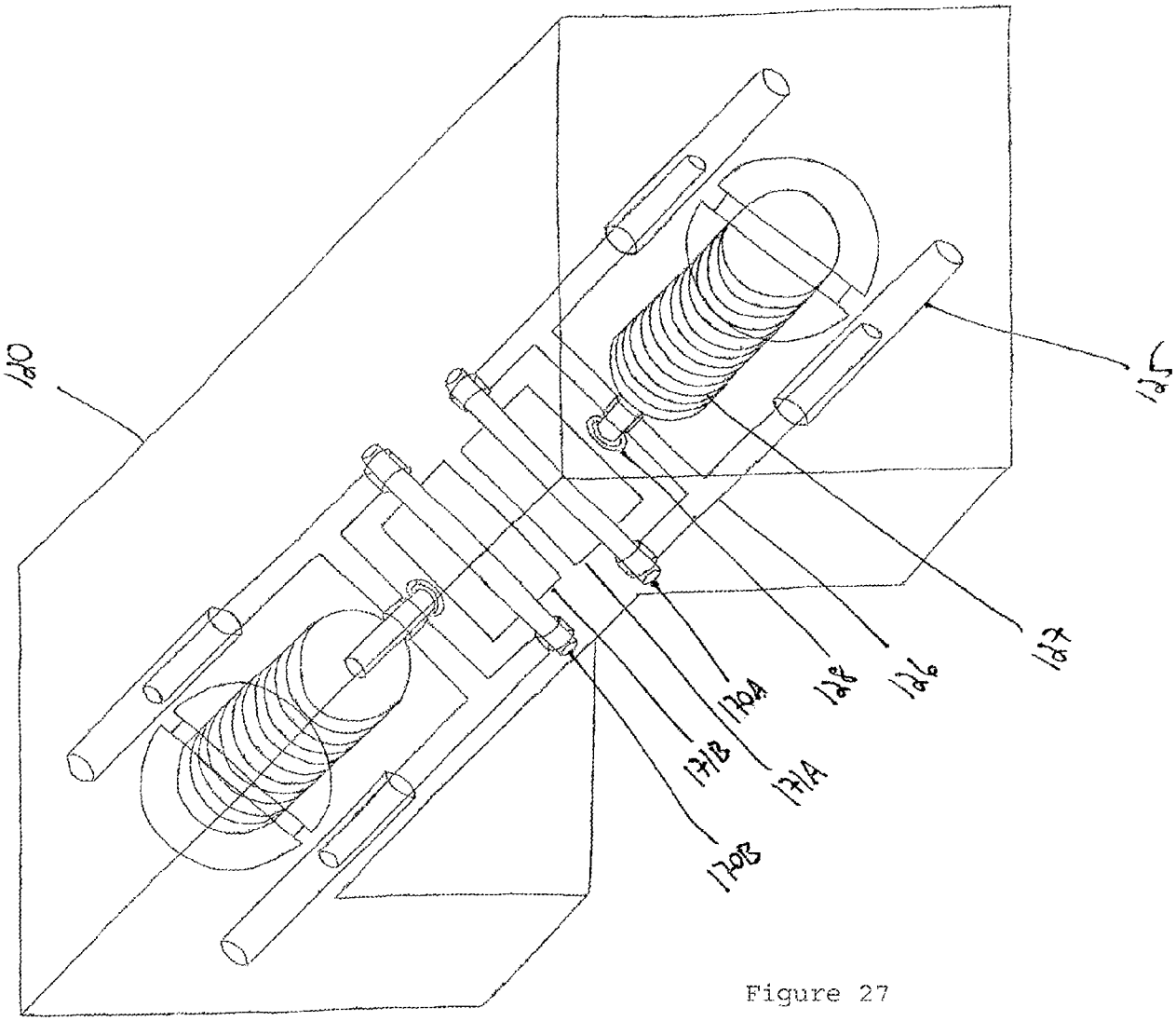
FIG. 27 shows a perspective view of the resistance device according to FIG. 26.

FIG. 27 shows the rollers of FIG. 26 having a set resistance to pedaling as shown by the resistance to the rollers that brace against the tire rims.

Figure 28:
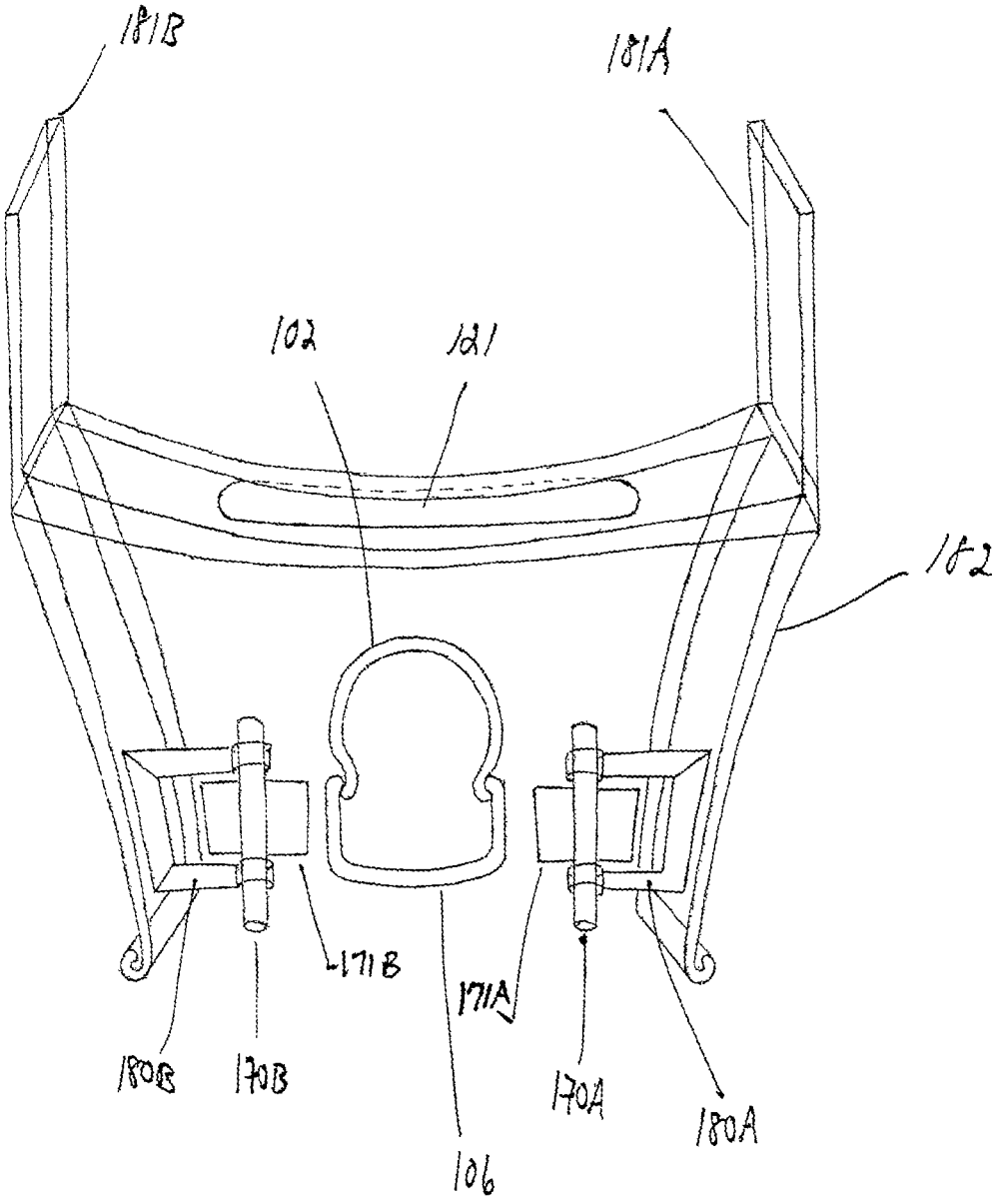
FIG. 28 shows a resistance device according to this disclosure in which the rollers are positioned via squeezable mechanical structure to adjust tension.

FIG. 28 uses rollers in a resistance device as in FIGS. 26 and 27, but in these embodiments, the resistance to pedaling is set by the elasticity of the materials that make the pliable frame 182 of the device. In FIG. 28, the resistance device incorporates squeezable top tabs 181A, B for positioning the rollers 171A, B over the tire rim.

Figure 29:
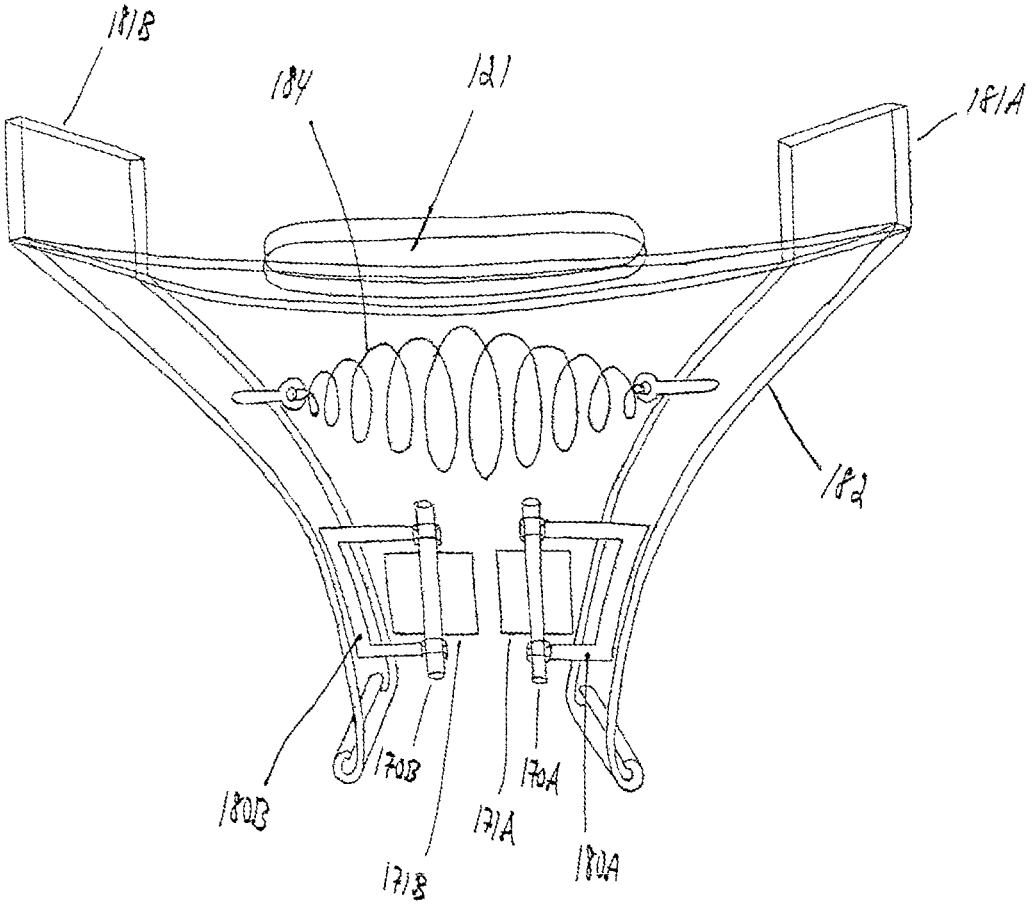
FIG. 29 shows a cross section of the resistance device according to FIG. 28 with the addition of a spring for tension adjustment.
Figure 30A:
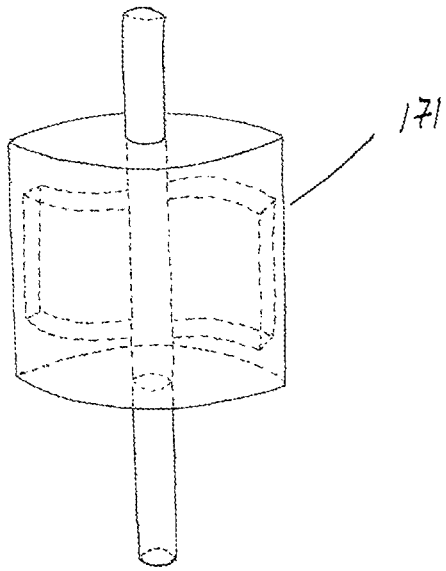
FIG. 30A-30D show various rollers for use with the resistance device of FIG. 26.
Figure 30B:
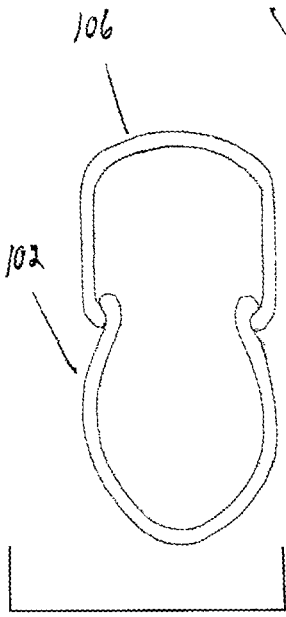
Figure 30C:
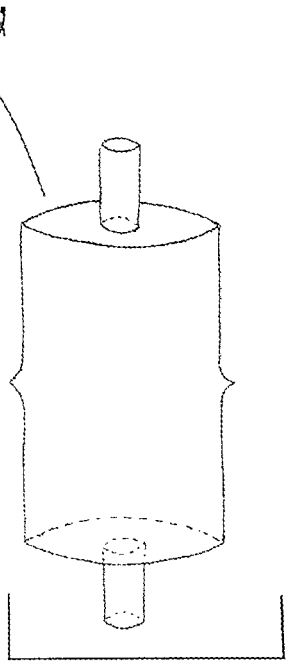
Figure 30D:
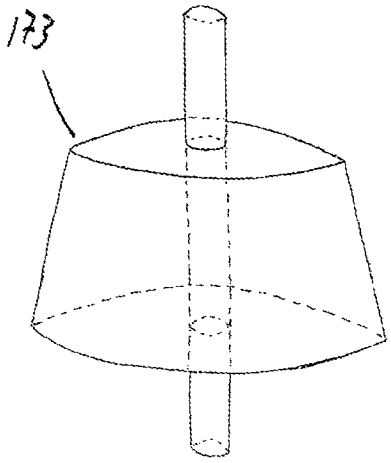

FIG. 29 adds a spring mechanism 184 to the unit of FIG. 27. Various embodiments of the rollers that can be used in this invention are set forth in FIGS. 30A, 30B, and 30C. The rollers may include paddles that rotate within resistance fluid to vary the resistance to pedaling (FIG. 30A). The rollers may engage both the rim and the tire body FIG. 30B, or may have an angled shape to engage particularly shaped tire rims. FIG. 30C.

Figure 31:
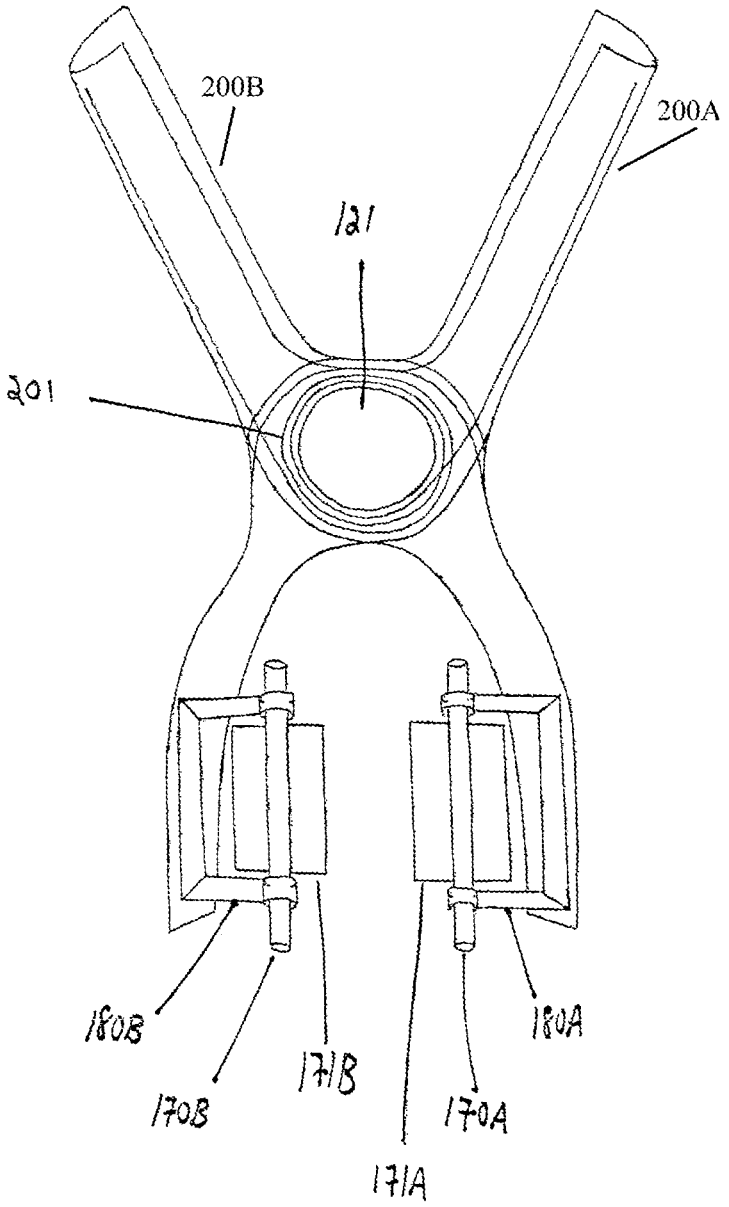
FIG. 31 shows a cross section of the resistance device of FIG. 29 with tension adjusting handles attached to a tension coil.
Figure 32:
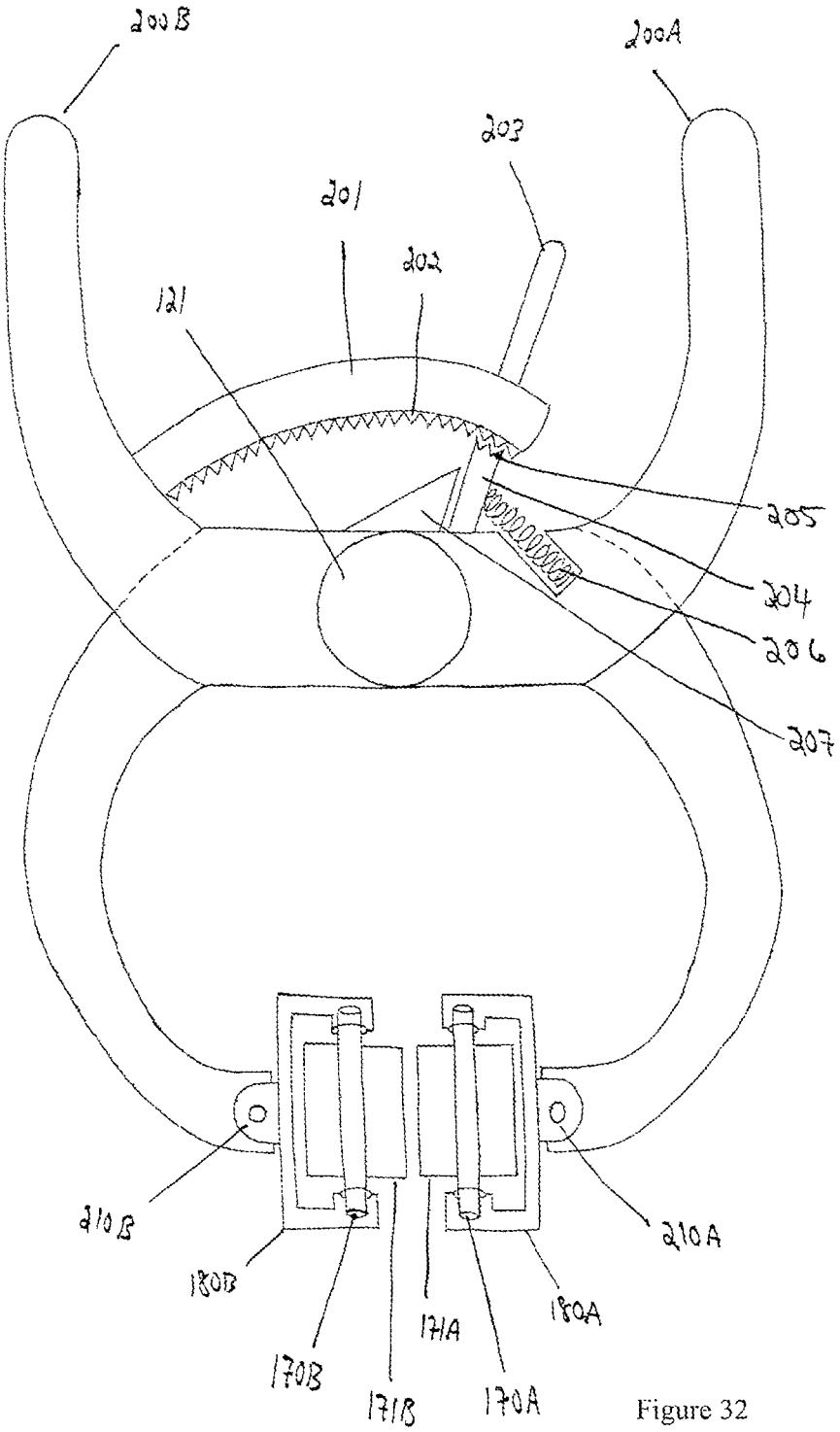
FIG. 32 shows a cross section of the resistance device of FIG. 29 with tension adjusting handles attached to a ratcheting mechanism.
Figure 33:
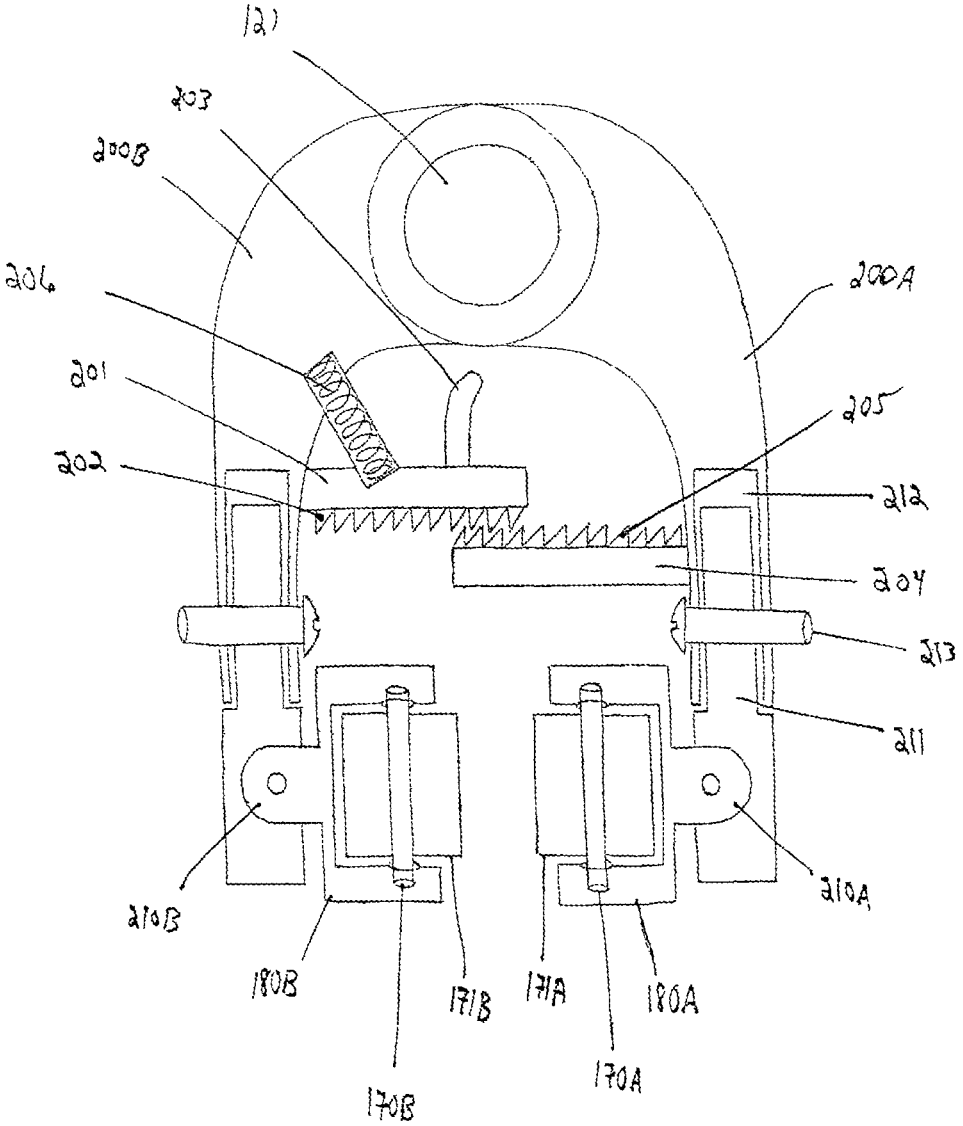
FIG. 33 shows a cross section of the resistance device of FIG. 32 defining an opening for attaching to the resistance support of FIG. 1.

FIGS. 31-33 illustrate an embodiment of the invention in which the resistance support 104 has a substantially round cross section. The resistance device is in the form of a clamp that fits over a tire rim and has a round opening 121 for fitting over the resistance support 104. A spring 201 inside the clamp sets the resistance of rollers 171A, B. FIGS. 32 and 33 use ratchets to allow for adjusting the tension of the rollers against the tire rim. Spring 206 keeps the teeth of the ratchet assembly engaged. FIG. 33 shows a more compact design with the ratchet assembly located within the interior of the clamp 200A. The clamp 200A is further characterized by an adjustable height controller 211, 212 set by screw 213 to allow for different sized tires fitting between the resistance support 104 and the rim of the bicycle tire.

Figure 34:
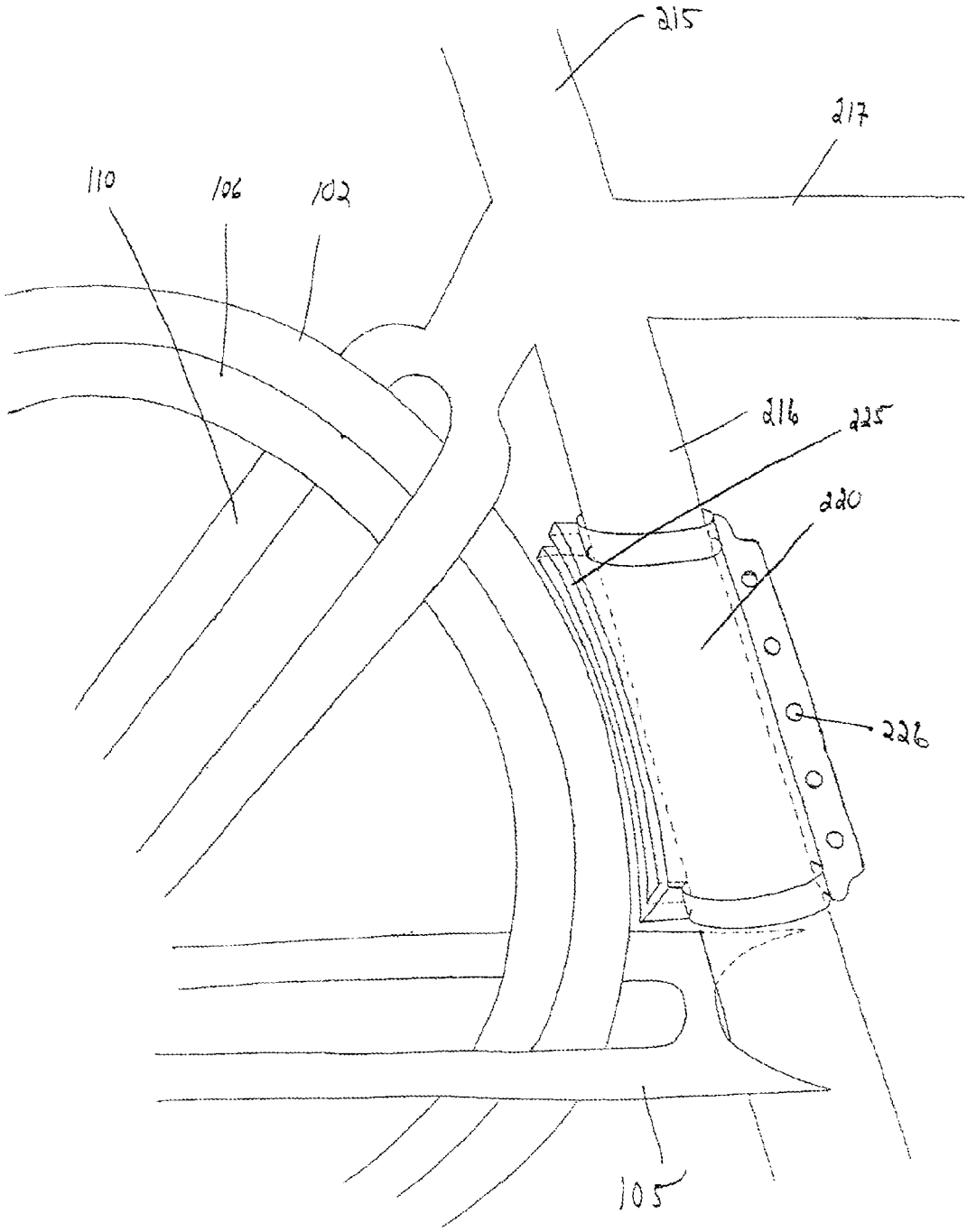
FIG. 34 shows an embodiment of this invention with a slotted resistance support attached to a seat tube on a bicycle.

FIG. 34 shows yet another position for attaching a resistance device that can be used on a standard bicycle. The resistance support is a bracket 220 that fits around a seat post 216. The bracket defines a slot 225 in which a resistance device fits.

Figure 35:
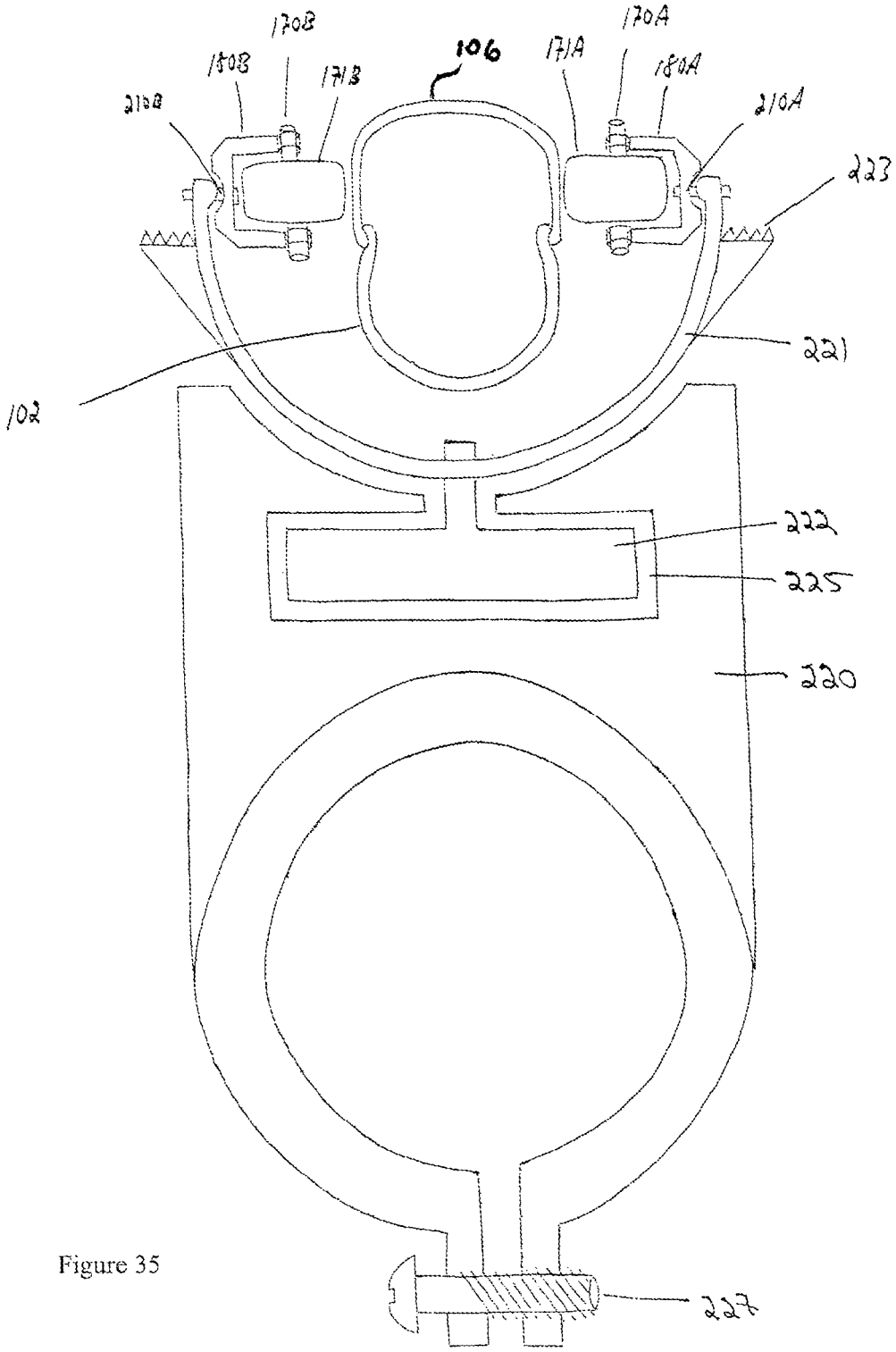
FIG. 35 shows a top view of a resistance device having a connector for sliding into the slot of the resistance support of FIG. 34.

FIG. 35 shows a cross section of FIG. 34 with a resistance device incorporating rollers 171A, B. The cross bar 222 of the resistance device fits down into the slot 225 of the bracket 220. Pliable frame 221 sets the tension by bracing the rollers against the rim. The frame is more readily installed by using thumb rests 223.

Figure 36:
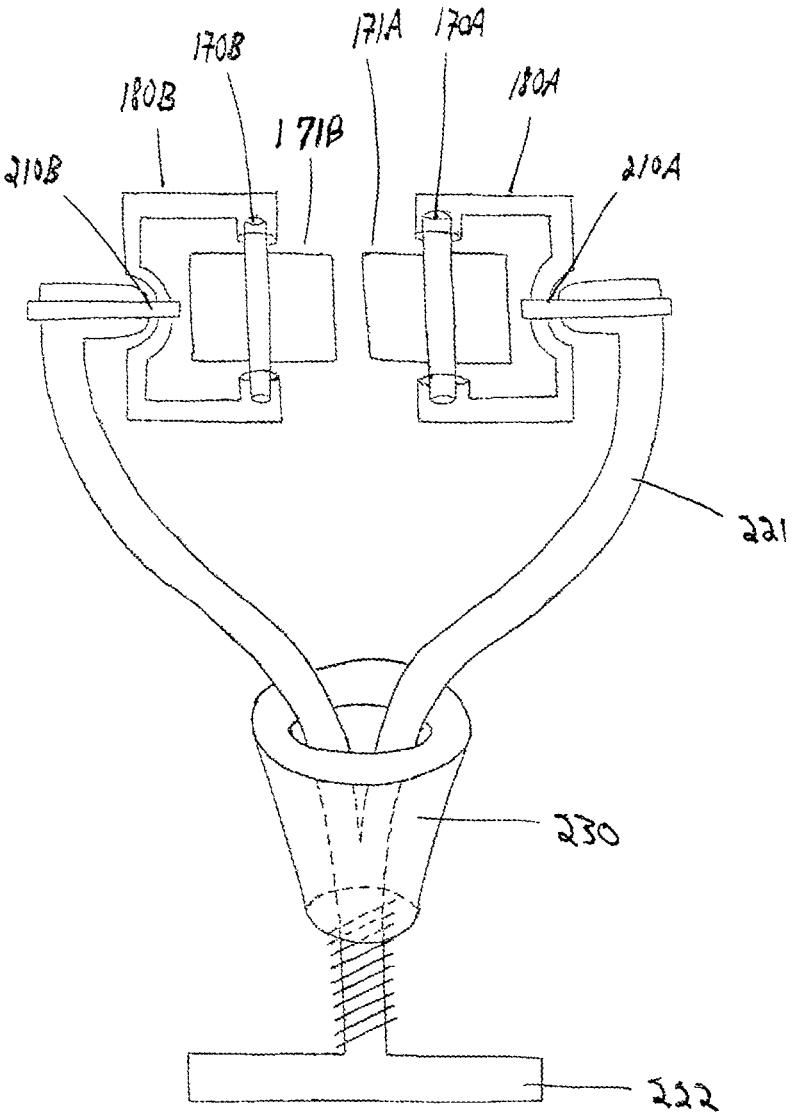
FIG. 36 shows an embodiment of a resistance device for connecting to the resistance support of FIG. 34 and incorporating a bifurcated tension cable for tightening rollers against a tire rim.

FIG. 36 shows a resistance device with a cross bar 222 that can fit within the bracket 220. A sliding pressure cap 230 engages a threading on the pliable frame to squeeze legs of the pliable frame together and force the rollers against the tire rim.

Figure 37:
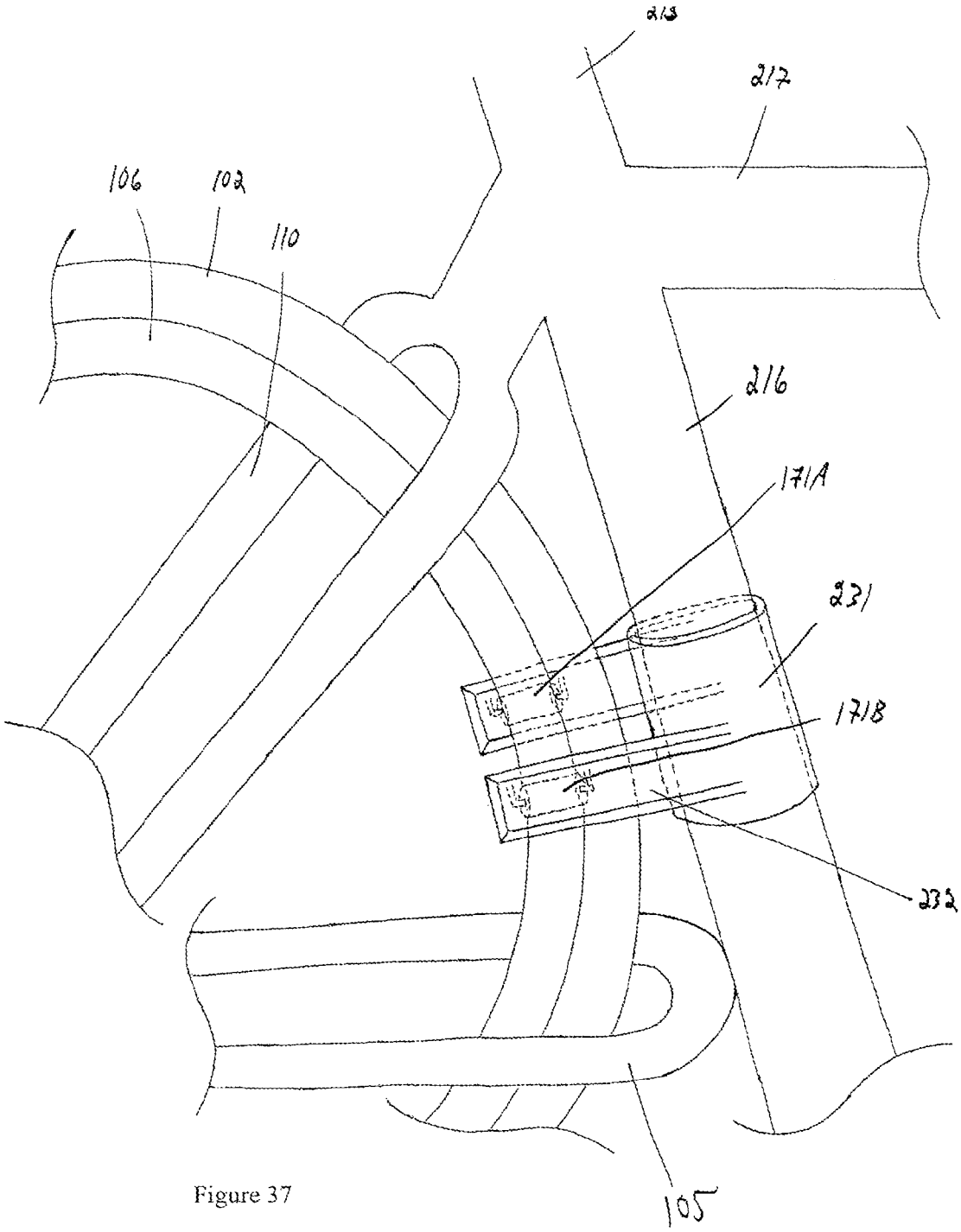
FIG. 37 shows a resistance device in the form of parallel rollers on opposite sides of a seat post.

FIG. 37 shows a seat post attachment in the form of arms on both sides of the seat post for attaching tension rollers to brace against the tire.

Figure 38:
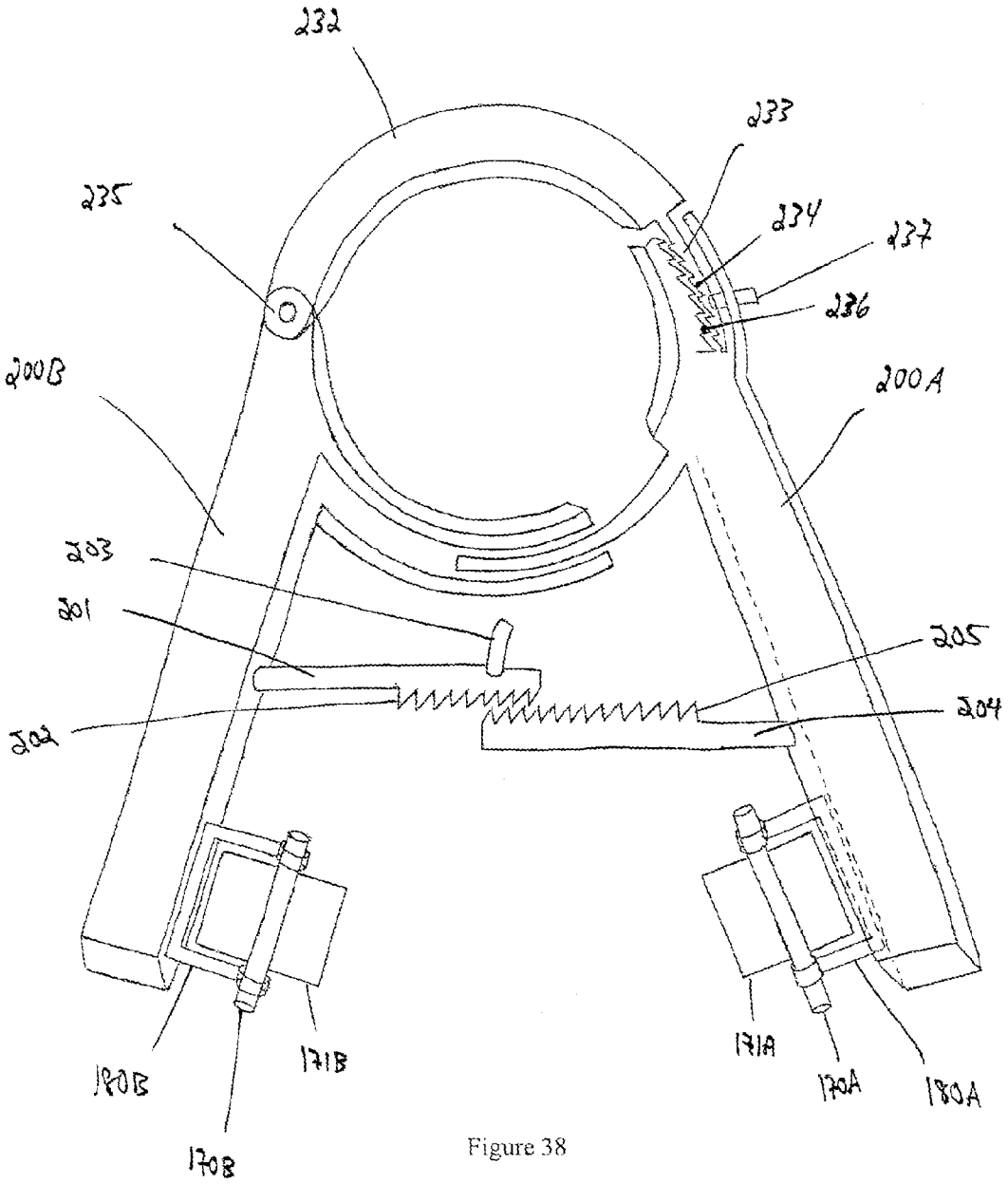
FIG. 38 shows a cross section of a roller oriented resistance device adjusted by a ratcheting mechanism.
Figure 39:
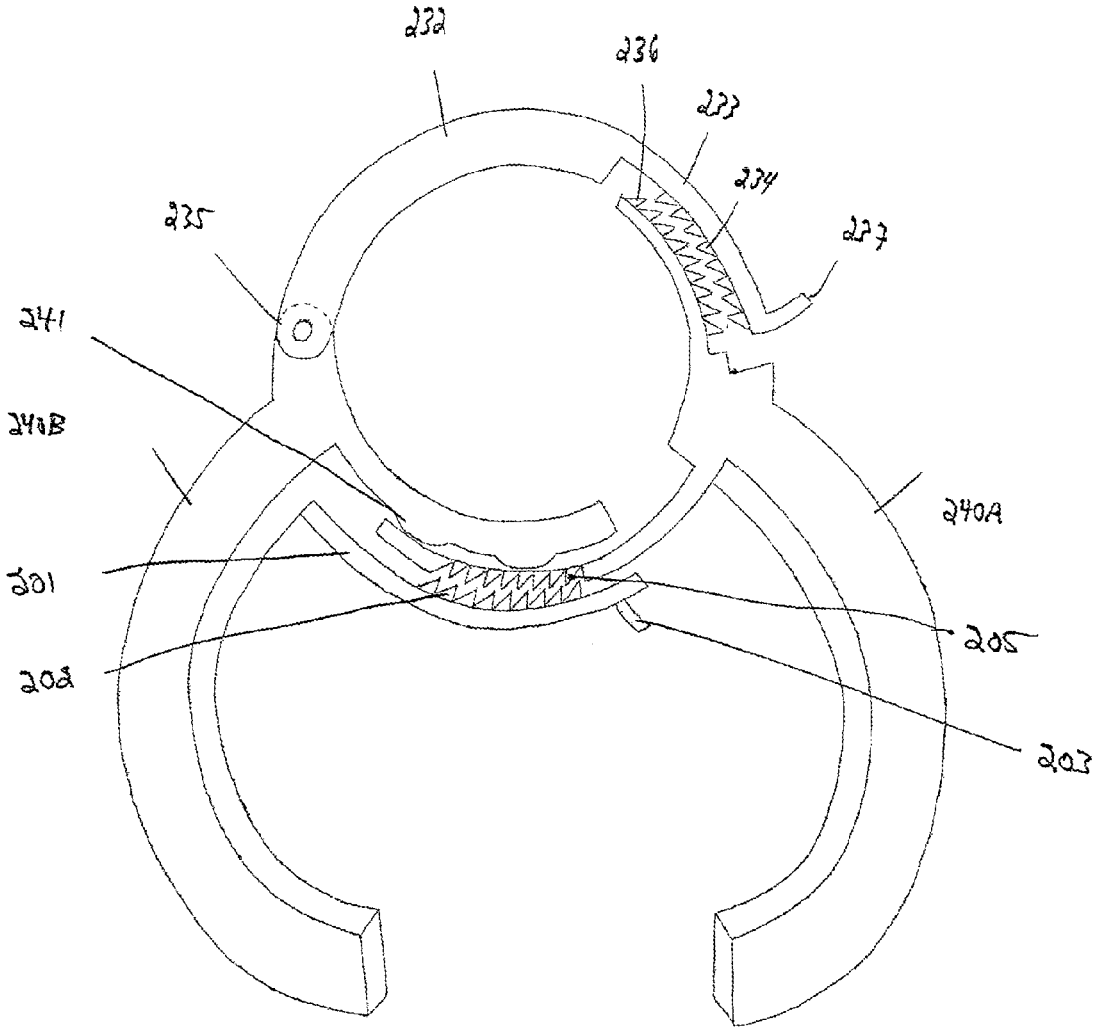
FIG. 39 shows the ratcheting mechanism with positioning nodes thereon.

FIGS. 38 and 39 show a seat post attachment with rollers 171A, B that provide resistance to pedaling by adding resistance to rear tire revolution. The attachment to the seat post is controlled by ratcheting mechanism 232-237 and the amount of tension the rollers emit onto the back tire of a bicycle is controlled by a second ratcheting mechanism 201-205. FIG. 39 shows nodes 241 providing positioning bumps to force the ratchet teeth 202 and 205 together. FIG. 39 further shows a more suitable shape for mountain bike tires.

Figure 40:
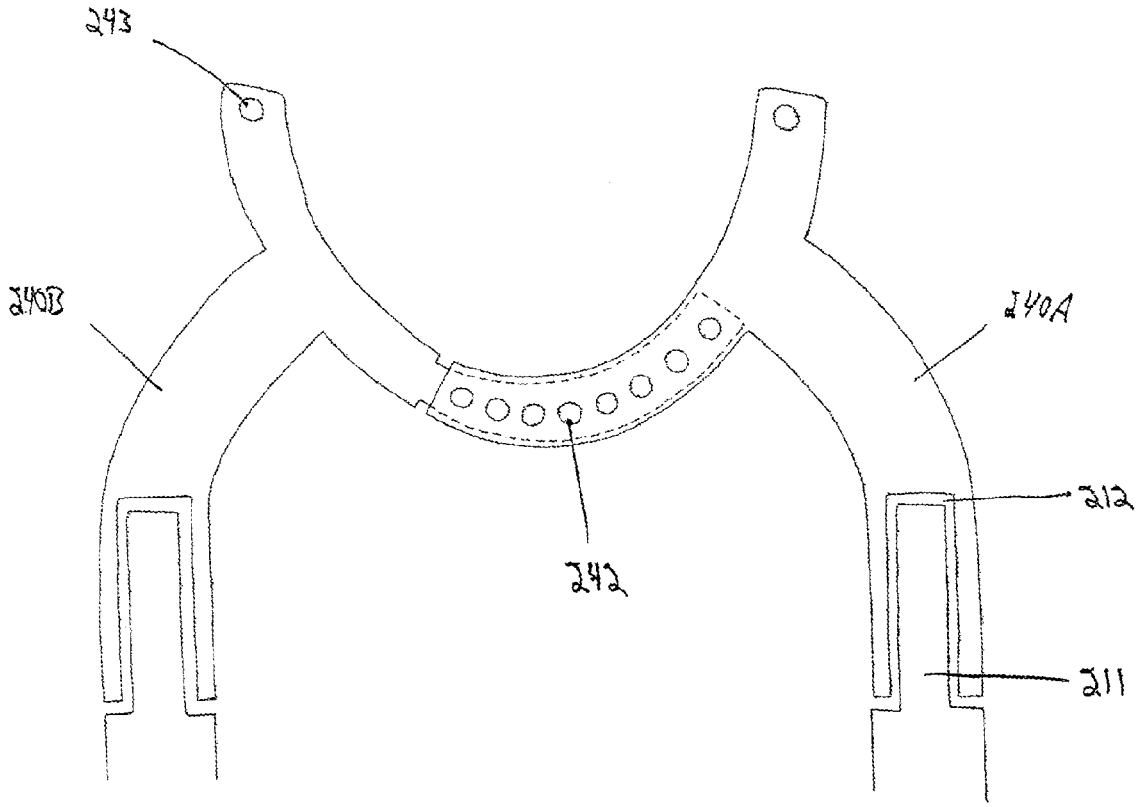
FIG. 40 shows a resistance device according to FIG. 36 with holes for receiving pins to adjust tension on the rollers.

FIG. 40 uses the same concepts of FIGS. 38 and 39 but instead of ratchets, holes with associated pins would accomplish the same function to hold the device to the seat post.

Figure 41:
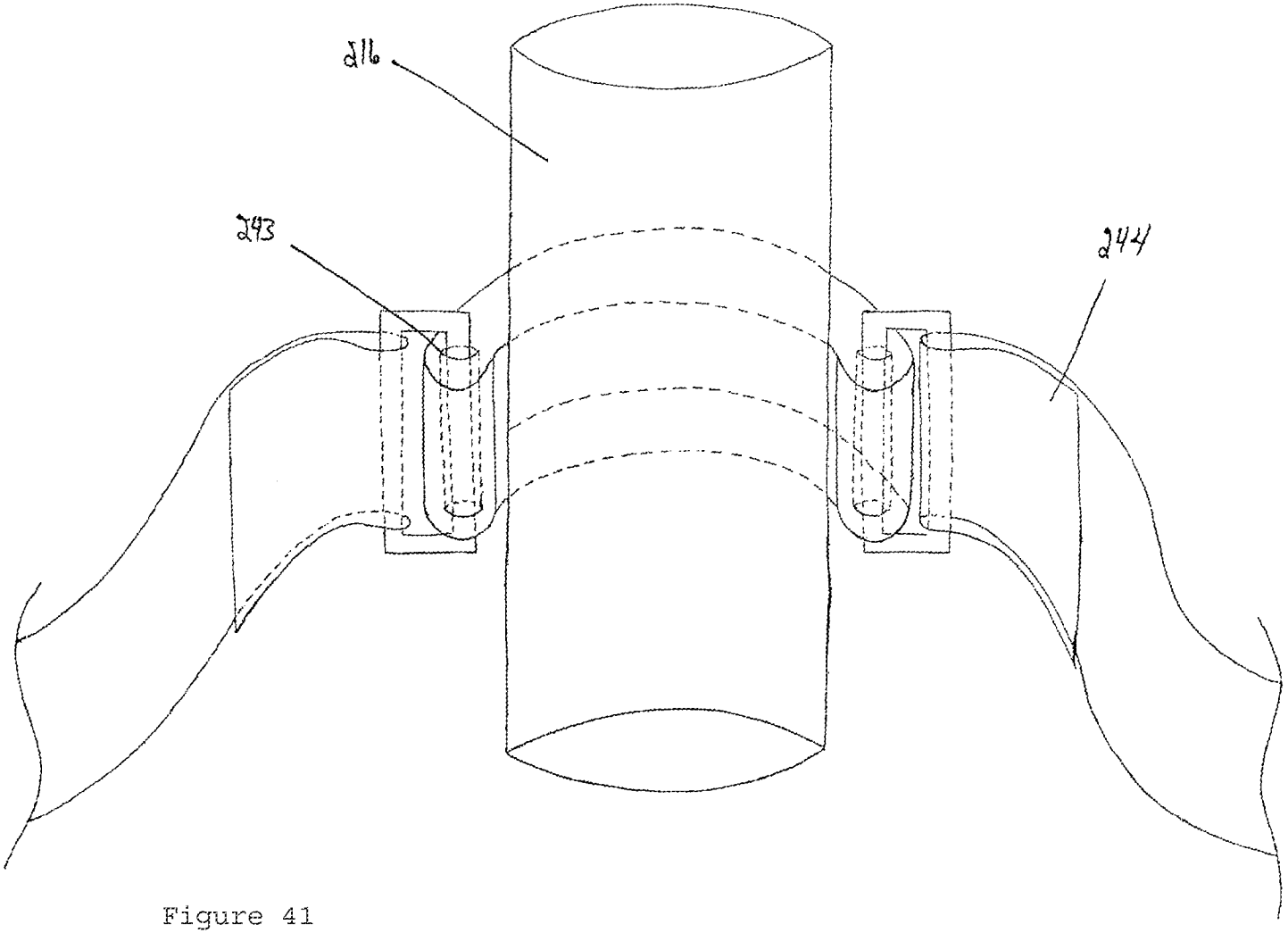
FIG. 41 is an embodiment of a resistance device according to FIG. 5 with attachment straps for attaching to the bicycle.

FIG. 41 shows a strap 244 connecting the resistance device to the seat post.

Figure 42:
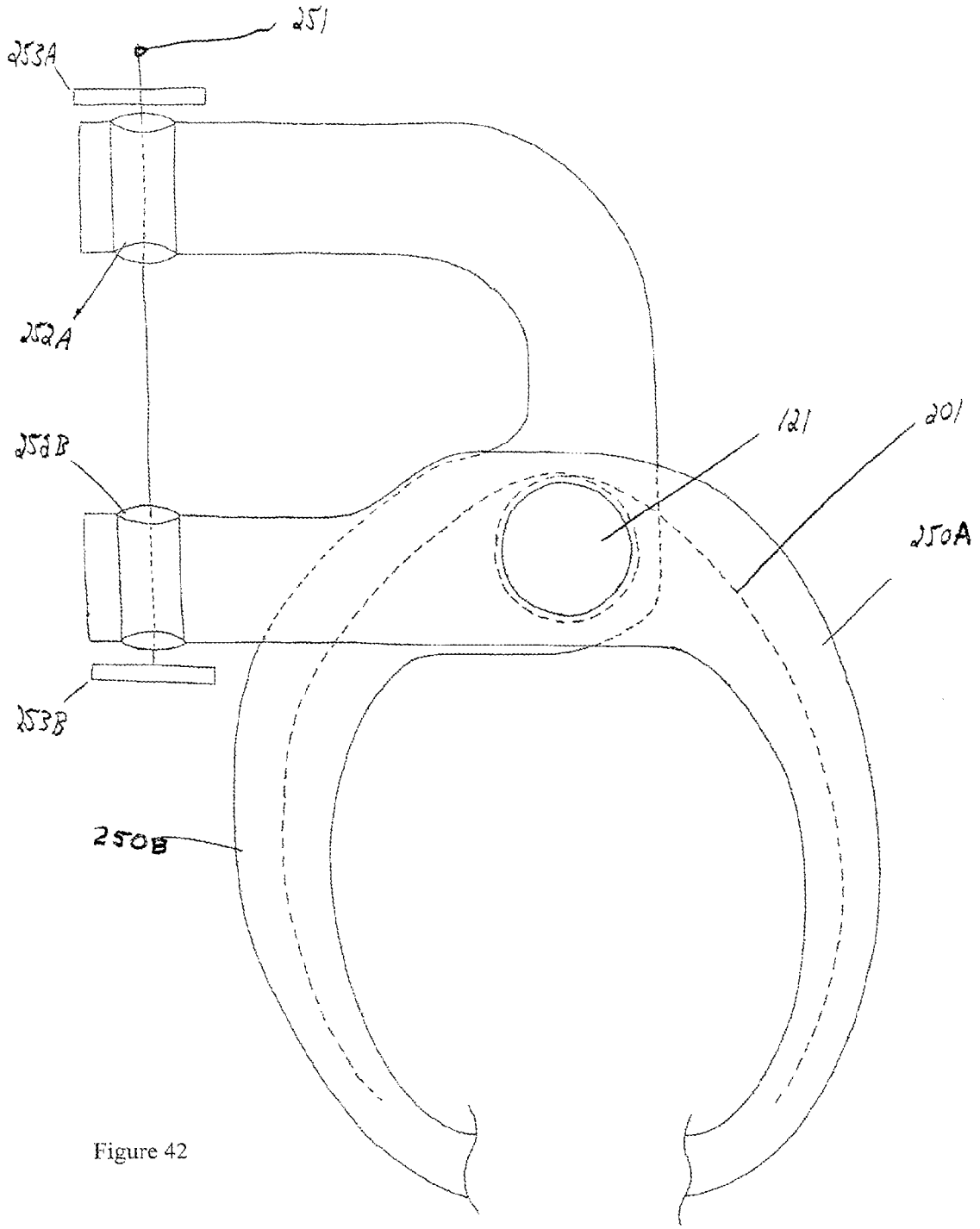
FIG. 42 shows a resistance device as disclosed herein with tension cables for adjusting the pressure on a bicycle tire.
Figure 43:
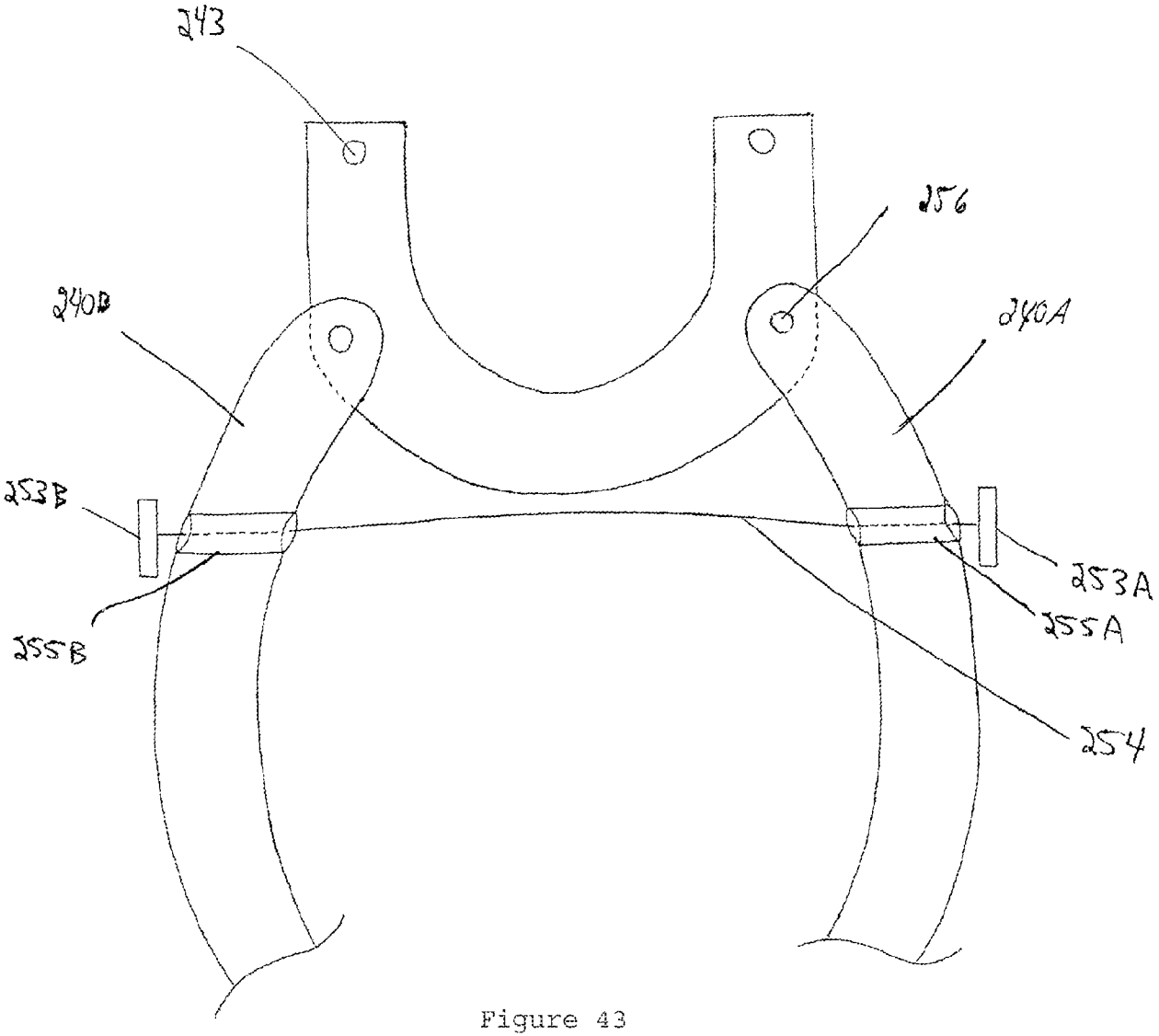
FIG. 43 shows a resistance device as disclosed herein with tension cables for adjusting the pressure on a bicycle tire.
Figure 44:
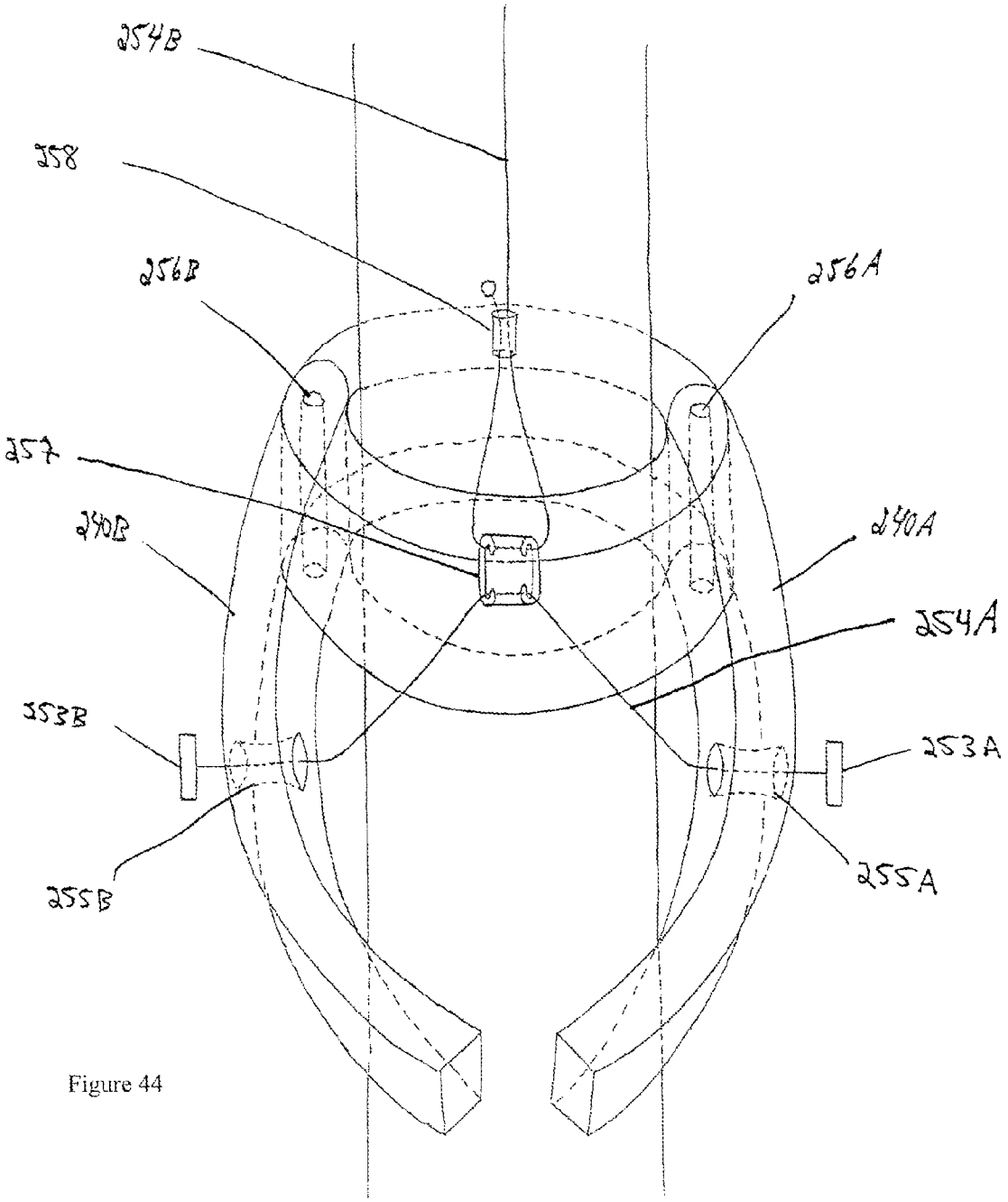
FIG. 44 shows a resistance device as disclosed herein with tension cables for adjusting the pressure on a bicycle tire.

FIGS. 42-44 show various embodiments of using cables that the rider can manipulate from the handle bars to engage and disengage the tension of rollers or magnetic plates similar to FIG. 9 on the resistance devices with the tire, side wall, rim, or disc brake. FIG. 42 is a rear view of the device attached to a resistance device 104 via the opening 121. The cable control mechanism would be positioned off the underside of the rider's seat. The cable goes up along seat post to handle bars where the user can clamp the rollers on or off or the position of the plates in relation the tire. FIG. 43 shows part of a seat post installation shown in more detail in FIG. 44. FIG. 43 shows the cable in a relaxed, non-engaged state while FIG. 44 incorporates a C-Clamp 257 to serve as the intermediate control between a handle bar connector cable 254B and the roller control cable 254A.

Figure 45:
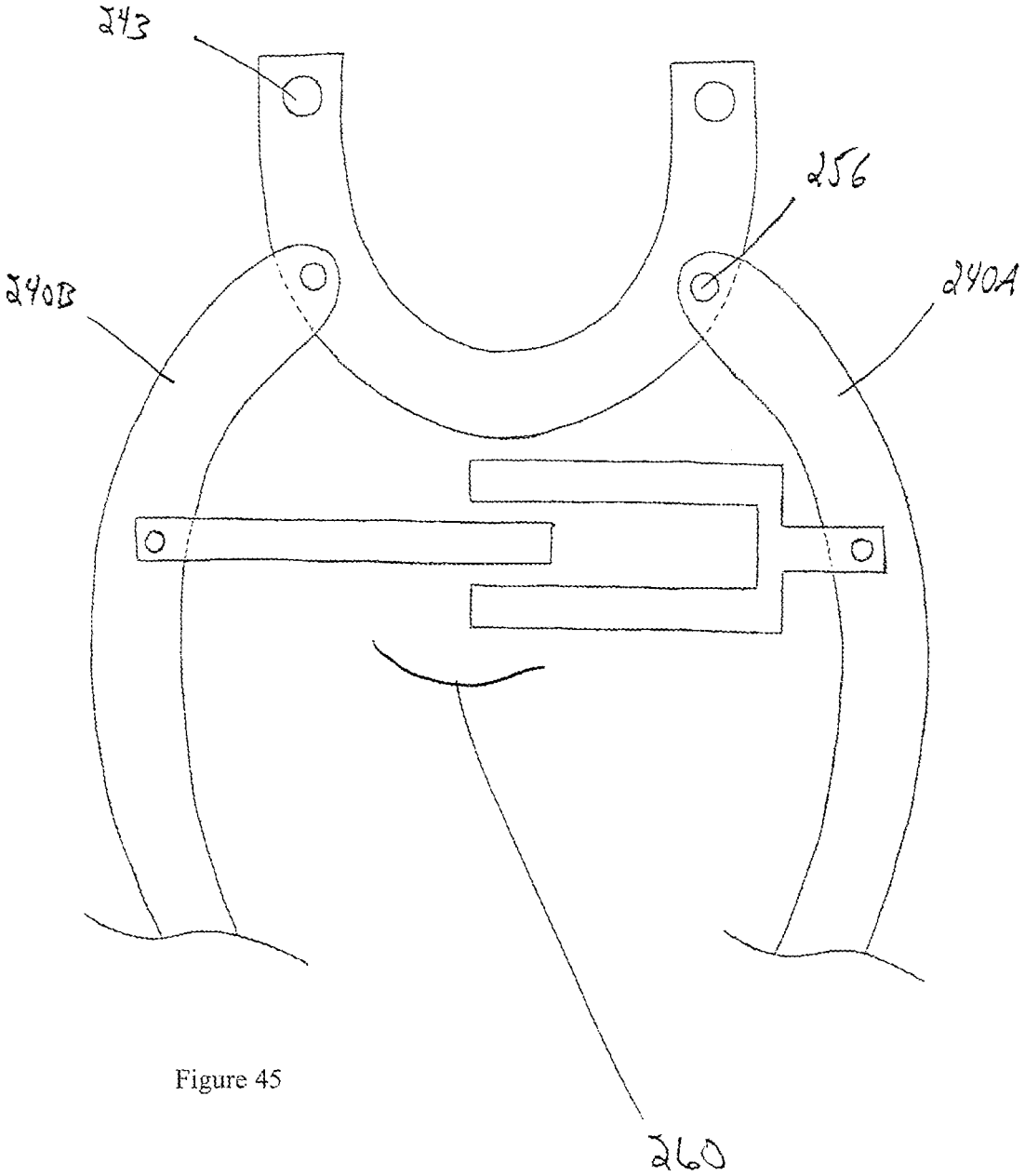
FIG. 45 shows a resistance device for attaching to a seat post and incorporating an electromagnetic resistance assembly according to the disclosure herein.

FIG. 45 shows a seat post attachment in which an electromagnet assembly 260 draws in the arms 240A, B. Circuitry controlled through the handle bar attachments (not shown) move the electromagnets in and out to adjust the position of associated rollers or other tension forming devices.

Figure 46A:
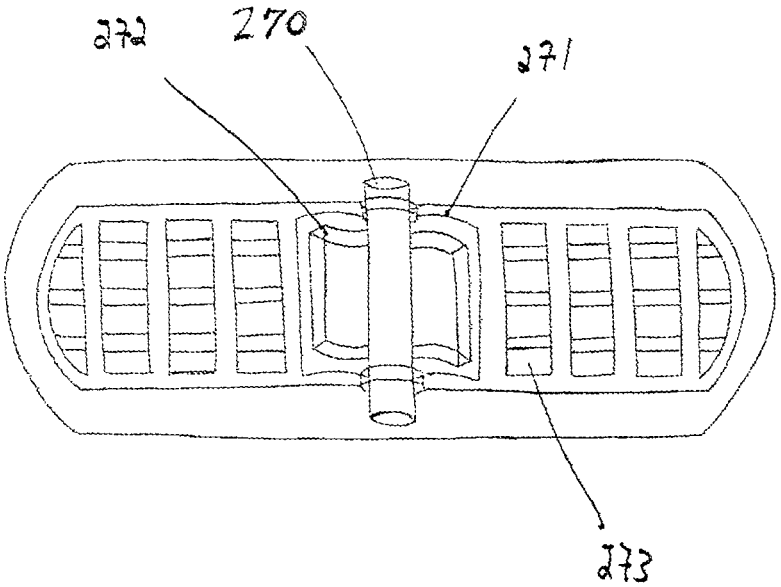
FIGS. 46A and 46B show a resistance assembly utilizing rollers embedded in brake pads.
Figure 46B:
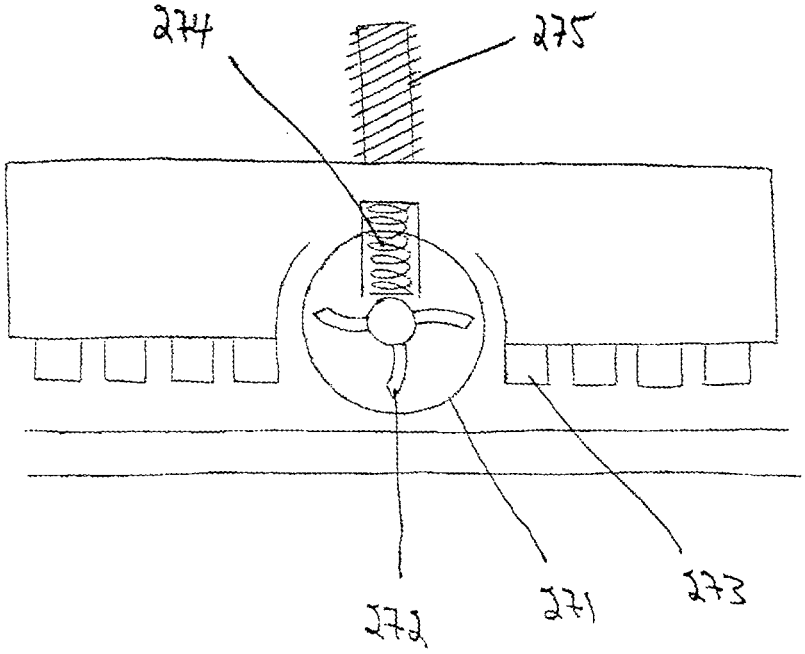

FIG. 46 shows rollers in brake pads that can be used to control resistance to pedaling in various fashions. In the embodiment of FIG. 46, while the user is riding the bicycle, a roller 271 is adjacent the tire. When the user engages the brakes from the handle bars, a spring 274 allows the rollers to retract so that the brakes engage the rim. A different embodiment shows that the brakes themselves could include rollers with internal paddles 272 in the rollers 271.

Figure 47A:
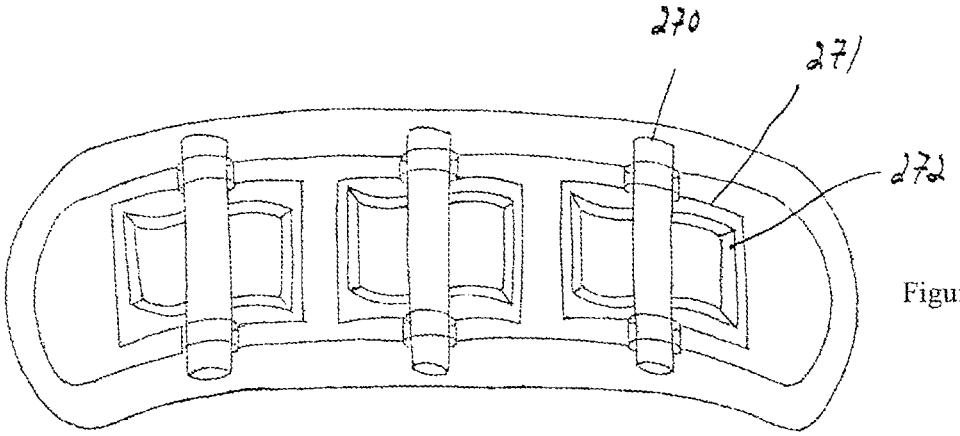
FIGS. 47A and 47B shows a resistance assembly utilizing multiple rollers embedded in the same brake pad.
Figure 47B:
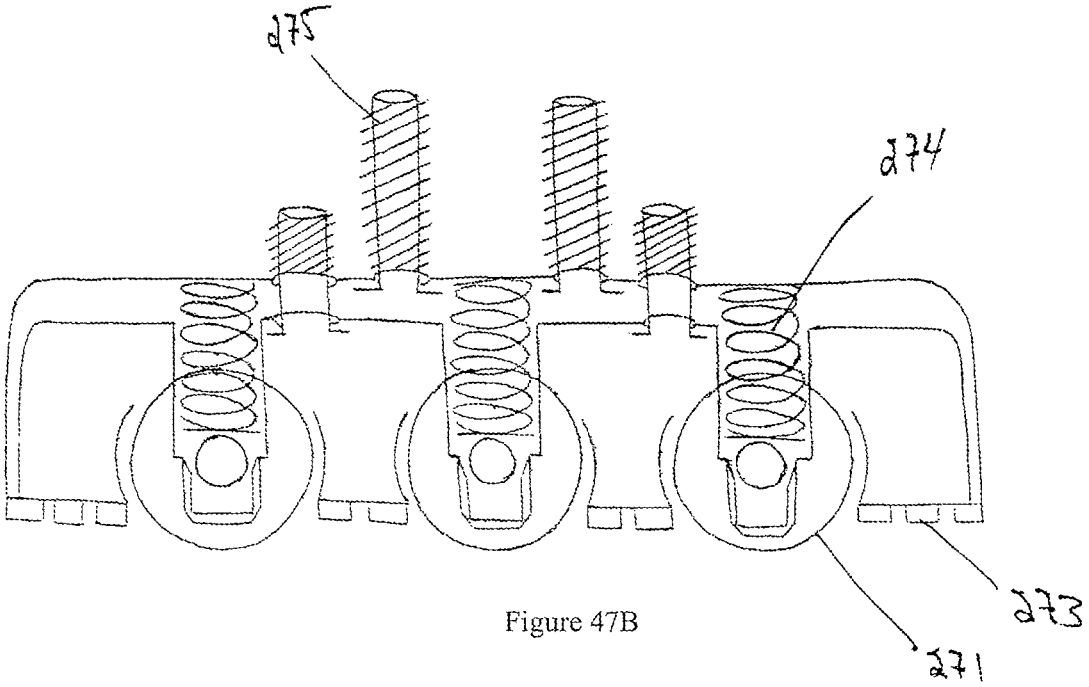

FIG. 47 shows multiple rollers on a single brake pad 273.

Figure 48A:
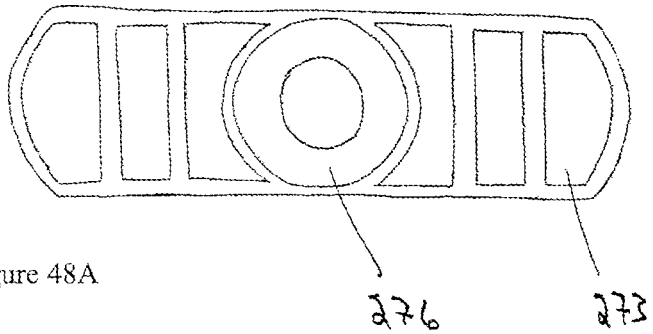
FIGS. 48A and 48B show a brake pad with an electromagnet embedded therein for use with a ferromagnetic assembly on a bicycle tire.
Figure 48B:
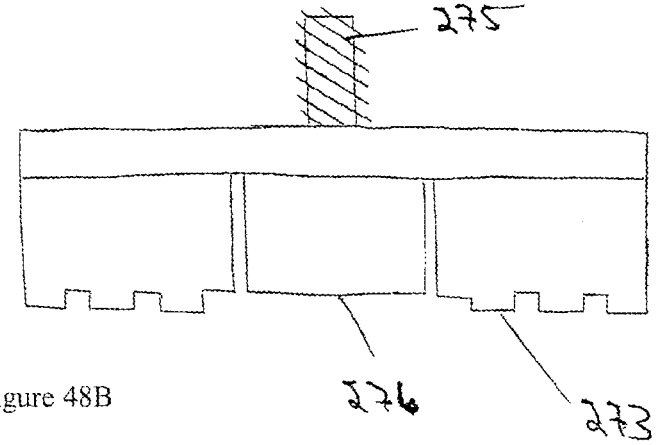

FIG. 48 shows the use of electromagnetic 276 in the brake pad 273 for magnetic resistance with the rim of a tire.

The following Parts List is useful for additional explanation of the anatomy of a bicycle and the structural connections between a bicycle, a resistance support, and a resistance device according to this invention bicycle stand 100
bicycle frame 101
rear tire 102
rear tire axle 103
resistance support 104
chainstay 105
Brackets: 111-114
Seat Stays: 110
Disc of the disc brake 150
Seat Stay attachment 151
Support arm 152
U-shaped magnet (specifically electromagnet) surrounding the disc 153
Derailleur 154
Pivot point 156
Resistance device 153
Pedal stem (Crankarm) 163
Pedals 164
Pedal cross bar 166
Horizontal Frame bar Chainring 165
Chainstay attachment 162
Support arm 152
Pivot Point 156
Ferromagnetic Pedal Disc 160
Roller having an Axle 170A, B
Roller having an Axle 171A, B
U-shaped Bracket 180A, B
Handles 200A, B
Ratchet clamp having Clamp Handles for squeezing inwardly 200A, B
Ratchet 201 having Inter-digitating 202 teeth and a ratchet handle 203
Post 204 having corresponding teeth 205 with a post support 207
Spring 206
Roller can pivot about pivot point 210 A, B to engage the rim properly
Seat Post 215
Seat Tube 216
Top Tube 217
Resistance Bracket 220
Slot for fitting the cross bar of a resistance device therein 225
Attachment holes 226 for receiving bolts for water bottle holder and the like
Resistance bracket 220 shown in cross section with securing screw 227
Pliable frame 221 for the resistance device (resistance depends on the flexibility of the frame and the inherent resistance of the roller itself)
Pressure Cap 230 engages a threading on the cross bar
Resistance Bracket 231
Arms 232
Curved Clamp handles 240 A, B that fit around a mountain bike tire
Positioning Bumps 241 provide pressure of one set of teeth onto the other
Cable 251 through openings in the bracket 252A, B
Resistance arms for holding the rollers 250A, B
Cable Stop 253 A, B
Cable 254
C-clamp 257
Rollers in the brake pad 273
spring 274

The invention claimed is:

1. A system for altering the resistance to tire revolution on a bicycle, the system comprising:

a resistance support configured for attaching to a bicycle proximate a bicycle tire; and a resistance device comprising a magnetic mechanism configured for attaching to the resistance support;

wherein the resistance device is configured to provide a magnetic force to alter resistance to the bicycle tire's revolution when the resistance support is attached to the bicycle, the resistance device is attached to the resistance support, and a user operates the bicycle along a travel surface.

2. A system according to claim 1, wherein the resistance device comprises an outer housing at least partially enclosing and providing support for the magnetic mechanism.

3. A system according to claim 2, wherein the outer housing defines a slot for sliding over and removably attaching to the resistance support.

4. A system according to claim 3, wherein the magnetic mechanism comprises a magnetic plate.

5. A system according to claim 4, wherein the outer housing is adapted to receive adjustable screws and the adjustable screws are configured to control the position of the magnetic plate relative to the bicycle tire.

6. A system according to claim 1, wherein the magnetic force that is provided by the resistance device is adjustable.

7. A system according to claim 1, wherein the resistance support comprises a bracket configured to attach to the bicycle frame proximate a rear tire of the bicycle.

8. A system according to claim 1, wherein the resistance device comprises an electromagnet.

9. A system according to claim 8, wherein the magnetic mechanism comprises a battery compartment.

10. A system according to claim 1, wherein the resistance device comprises a ferromagnetic metal.

11. A bicycle and resistance device combination for altering the resistance to tire revolution on the bicycle, the combination comprising:

a bicycle comprising a resistance support attached to the bicycle proximate a bicycle tire; and a resistance device comprising a first magnetic mechanism attached to the resistance support;

wherein a second magnetic mechanism is attached to the bicycle tire or wheel;

wherein the resistance device is configured to provide a magnetic force to alter resistance to the rotation of the bicycle tire.

12. A combination according to claim 11, wherein the second magnetic mechanism is removably attached to the bicycle tire.

13. A combination according to claim 12, wherein the second magnetic mechanism is a magnetic sleeve.

14. A combination according to claim 11, wherein the second magnetic mechanism is incorporated into the bicycle tire.

15. A combination according to claim 11, wherein the second magnetic mechanism is attached to the bicycle wheel.

16. A combination according to claim 15, wherein the second magnetic mechanism comprises a magnetic clip.

17. A combination according to claim 11, wherein the second magnetic mechanism is incorporated onto the axle of a bicycle wheel.

18. A method of altering the resistance to tire revolution on a bicycle, comprising:

providing a bicycle, the bicycle comprising:

a resistance support attached to the bicycle proximate a bicycle tire;

a resistance device comprising a first magnetic mechanism attached to the resistance support; and a second magnetic mechanism attached to a wheel, an axle, or to the tire of the bicycle; and positioning the first and second magnetic mechanisms in proximity to each other such that a magnetic force altering the resistance to tire revolution is applied when a user operates the bicycle.

19. The method of claim 18, further comprising:

adjusting the position of the first magnetic mechanism relative to the second magnetic mechanism.

20. The method of claim 18, further comprising:

adjusting the amount of the magnetic force that is applied.

* * * * *